US007823868B2

(12) United States Patent
Taki et al.

(10) Patent No.: US 7,823,868 B2
(45) Date of Patent: Nov. 2, 2010

(54) SHEET FINISHING APPARATUS AND CONTROL METHOD

(75) Inventors: Hiroyuki Taki, Shizuoka (JP); Mikio Yamamoto, Shizuoka (JP); Shinichiro Mano, Kanagawa (JP); Toshiaki Oshiro, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 294 days.

(21) Appl. No.: 12/169,069

(22) Filed: Jul. 8, 2008

(65) Prior Publication Data

US 2009/0014941 A1 Jan. 15, 2009

Related U.S. Application Data

(60) Provisional application No. 60/949,477, filed on Jul. 12, 2007, provisional application No. 60/949,485, filed on Jul. 12, 2007, provisional application No. 60/952,352, filed on Jul. 27, 2007, provisional application No. 60/968,293, filed on Aug. 27, 2007, provisional application No. 60/968,294, filed on Aug. 27, 2007, provisional application No. 60/968,295, filed on Aug. 27, 2007, provisional application No. 60/968,296, filed on Aug. 27, 2007, provisional application No. 60/968,298, filed on Aug. 27, 2007, provisional application No. 60/968,849, filed on Aug. 29, 2007.

(51) Int. Cl.
*B65H 37/04* (2006.01)

(52) U.S. Cl. ..... 270/58.09; 270/58.07; 399/407

(58) Field of Classification Search ..... 270/58.07, 270/58.08, 58.09; 399/407
See application file for complete search history.

(56) References Cited

U.S. PATENT DOCUMENTS

| | | | | |
|---|---|---|---|---|
| 5,269,503 | A * | 12/1993 | Hiroi et al. | 270/58.09 |
| 7,240,898 | B2 * | 7/2007 | Takamura et al. | 270/58.09 |
| 7,360,757 | B2 * | 4/2008 | Parker et al. | 270/58.07 |
| 7,404,550 | B2 * | 7/2008 | Vogel et al. | 270/52.18 |

FOREIGN PATENT DOCUMENTS

| | | |
|---|---|---|
| JP | 4-332673 | 11/1992 |
| JP | 9-73251 | 3/1997 |
| JP | 11-180617 | 7/1999 |
| JP | 2000-278469 | 10/2000 |
| JP | 2002-307780 | 10/2002 |
| JP | 2004-123239 | 4/2004 |

* cited by examiner

*Primary Examiner*—Patrick Mackey
(74) *Attorney, Agent, or Firm*—Patterson & Sheridan, LLP

(57) ABSTRACT

A sheet finishing apparatus includes an inlet roller to receive a sheet conveyed from an image forming apparatus, a sheet introduction unit to guide the sheet received by the inlet roller to a finishing unit, a sheet ejection unit to guide the sheet performed to a post process by the finishing unit to an ejection port and to eject from the ejection port, a paper storage tray to receive the ejected sheet, a drive unit including a plurality of motors to drive respective devices, and a control unit to control operations of the plurality of motors. In a trial operation of the sheet finishing apparatus, the control unit controls the plurality of motors, and first drives a motor with a sound pressure level less than a previously set reference level.

18 Claims, 28 Drawing Sheets

SHEET FINISHING APPARATUS AND CONTROL METHOD

CROSS-REFERENCE TO RELATED APPLICATION

This application is based upon and claims the priority of

U.S. Provisional Application No. 60/949,477, filed on Jul. 12, 2007,

U.S. Provisional Application No. 60/949,485, filed on Jul. 12, 2007,

U.S. Provisional Application No. 60/952,352, filed on Jul. 27, 2007,

U.S. Provisional Application No. 60/968,293, filed on Aug. 27, 2007,

U.S. Provisional Application No. 60/968,294, filed on Aug. 27, 2007

U.S. Provisional Application No. 60/968,295, filed on Aug. 27, 2007,

U.S. Provisional Application No. 60/968,296, filed on Aug. 27, 2007,

U.S. Provisional Application No. 60/968,298, filed on Aug. 27, 2007, and

U.S. Provisional Application No. 60/968,849, filed on Aug. 29, 2007, the entire contents of which are incorporated herein by reference.

TECHNICAL FIELD

The present invention relates to a sheet finishing apparatus for performing a finishing on a sheet ejected from an image forming apparatus, such as a copier, a printer or a multi-function peripherals (MFP), and a control method of the same, and particularly to the reduction of noise and the realization of power saving.

BACKGROUND

In recent years, in an image forming apparatus (for example, an MFP), a sheet finishing apparatus is provided to be adjacent to the rear stage of the MFP in order to perform a finishing on a sheet after image formation. The sheet finishing apparatus is called a finisher, and is for punching a hole in the sheet fed from the MFP or for performing a stapling and for ejecting it. Besides, a sheet bundle is folded in half and is ejected.

In the sheet finishing apparatus (finisher) as stated above, when the power is turned on or if a return is made from a power saving mode to a normal mode, trial operation is performed in order to confirm whether a sheet receiving mechanism operates normally.

Besides, if a sheet is clogged in the inside of the sheet finishing apparatus and a jam occurs, it is necessary to remove the jam. At the time of the jam removal operation, since the user touches the inside of the machine, there is a case where various devices are moved to positions shifted from their home positions. Thus, after the jam removal, various mechanisms are returned to the home positions and the trial operation is performed.

If the trial operation as stated above is performed, since there is a person who works near the MFP according to the office environment, when the MFP or the finisher suddenly starts the operation, the sound is very offensive to the ear.

Especially, when some devices constituting a mechanism simultaneously operate, the sound pressure level rises and the sound is disagreeable. Besides, there is a case where the fluctuation of the sound pressure abruptly occurs, and becomes a noise which is offensive to the ear.

Besides, a sheet ejection port for ejecting a sheet bundle subjected to a stapling is provided in the inside of the finisher, and since noise generated in a space extending from a stapler to the sheet ejection port is reflected and resonates in the space, reverberant sound occurs, and the noise is discharged from the sheet ejection port to the outside.

Besides, since the finisher includes the sheet ejection port, there is a danger that the user touches an inside device through the ejection port.

Further, if the finisher is provided to be adjacent to the MFP, although the power of the finisher is supplied from the MFP, since the capacity of current supplied from the MFP to the finisher is limited, it is necessary to reduce the power consumption.

JP-A-2002-307780 discloses an image forming apparatus in which noise is reduced. In this example, sound absorbing means is provided in the inside of the image forming apparatus.

JP-A-4-332673 discloses an image forming apparatus in which noise is reduced. In this example, a speaker is provided which outputs a sound wave to cancel a noise when the noise is generated.

JP-A-2004-123239 discloses an exhaust structure of an image forming apparatus. In this example, a screen member is provided at a joint between the image forming apparatus and a finishing apparatus.

JP-A-11-180617 discloses a sheet ejection mechanism of an image forming apparatus. In this example, a safety bar is provided in order to prevent a finger from being nipped at the time of movement of a paper storage tray.

JP-A-9-73251 discloses a finishing apparatus of a sheet member. In this example, the increase of power consumption and the increase of noise caused by an initializing operation are suppressed.

JP-A-2000-278469 discloses a facsimile apparatus including a sensor control device. In this example, the power consumption of a sensor is reduced.

However, in the above examples, the reduction of noise and the reduction of power consumption are still insufficient, and there is a room for further improvement.

SUMMARY

According to an aspect of the present invention, a sheet finishing apparatus, comprising:

an inlet roller to receive a sheet;

a sheet introduction unit configured to align the sheet received by the inlet roller;

a finishing unit configured to perform finishing on the sheet conveyed by the sheet introduction unit;

a sheet ejection unit configured to guide the sheet performed to the finishing by the finishing unit to an ejection port and to eject the sheet from the ejection port;

a storage tray that moves up and down and receives the sheet ejected from the ejection port;

a drive unit configured to drive respective devices existing between the inlet roller and the storage tray and including a plurality of motors having sound pressure levels less than a previously set reference level and a plurality of motors having sound pressure levels higher than the previously set reference level; and a control unit configured to control the drive unit in a trial operation of the sheet finishing apparatus, to first drive any one of the motors having the sound pressure levels less than the previously set reference level, and then to drive other motors including the plurality of motors having the sound pressure levels higher than the previously set reference level.

DETAILED DESCRIPTION

Figure 1:
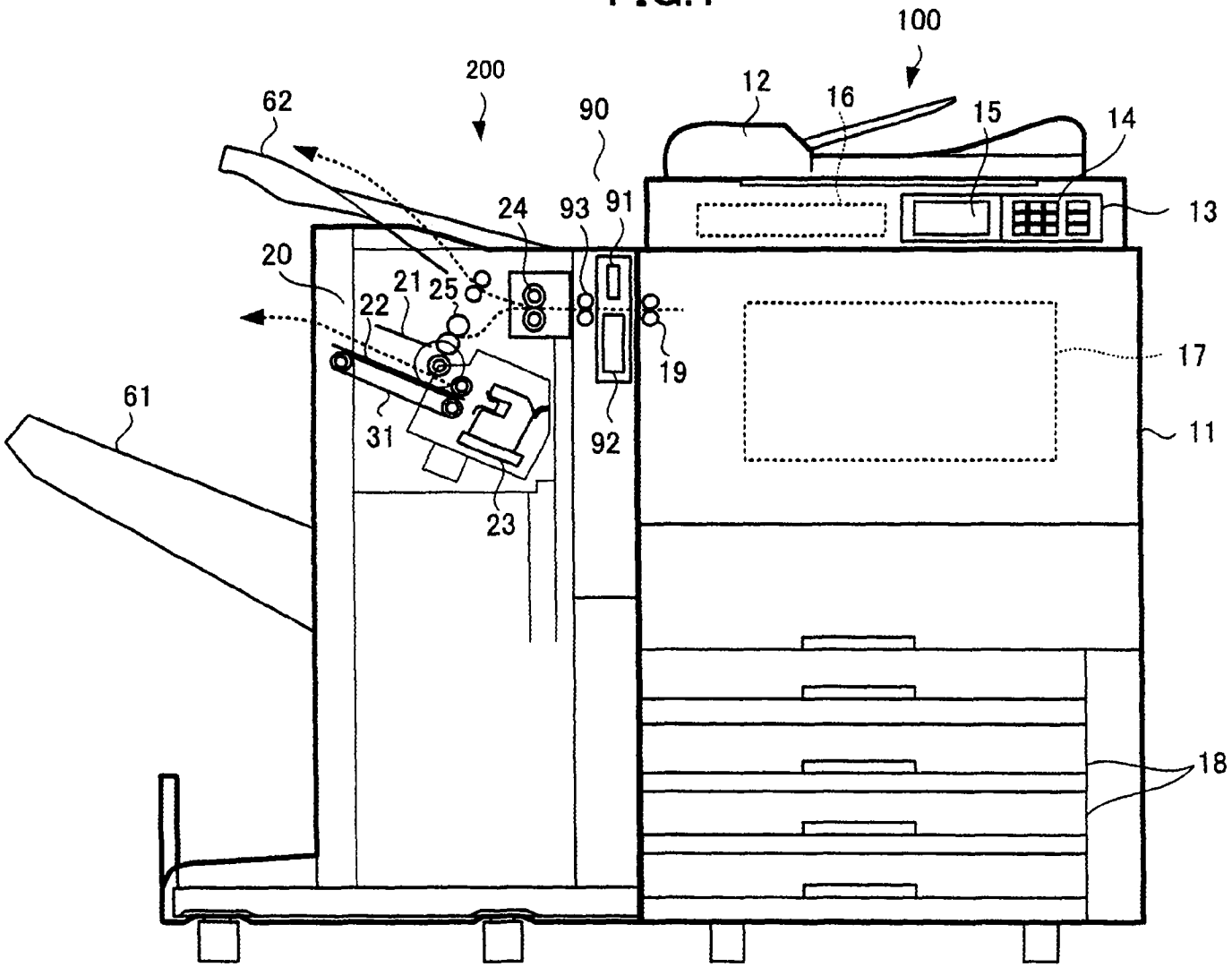
FIG. 1 is a schematic structural view showing a sheet finishing apparatus of an embodiment and an image forming apparatus.

Throughout this description, the embodiments and examples shown should be considered as exemplars, rather than limitations on the apparatus of the present invention.

Hereinafter, embodiments will be described in detail with reference to the drawings. Incidentally, in the drawings, the same portions are denoted by the same reference numerals and their description will be made.

FIG. 1 is a structural view showing an embodiment of a sheet finishing apparatus. In FIG. 1, reference numeral 100 denotes an image forming apparatus which is, for example, an MFP (Multi-Function Peripherals) as a compound machine, a printer, a copier or the like. A sheet finishing apparatus 200 is disposed to be adjacent to the image forming apparatus 100. In the following explanation, the MFP is used as an example of the image forming apparatus 100.

A sheet on which an image is formed by the MFP 100 is conveyed to the sheet finishing apparatus 200. The sheet finishing apparatus 200 performs a finishing on the sheet supplied from the MFP 100, and performs, for example, a sorting and a stapling. Besides, as the need arises, the sheet is saddle stitched, and then is folded in half and is ejected. Since the sheet finishing apparatus 200 is generally called a finisher, in the following description, there is a case where the word of the finisher 200 is used.

Incidentally, in the embodiment of FIG. 1, there is shown an example in which a punch mechanism 90 is provided between the MFP 100 and the finisher 200. The punch mechanism 90 is also a kind of sheet finishing apparatus.

In FIG. 1, an original document table (not shown) is provided on the upper part of a main body 11 of the MFP 100, and an automatic document feeder (ADF) 12 is openably and closably provided on the original document table. Further, an operation panel 13 is provided on the upper part of the main body 11. The operation panel 13 includes an operation unit 14 having various keys and a touch panel type display unit 15.

A scanner unit 16 and a printer unit 17 are provided in the inside of the main body 11, and plural cassettes 18 in which various sizes of sheets are contained are provided at the lower part of the main body 11. The scanner unit 16 reads an original document fed by the ADF 12 or an original document placed on the original document table.

Besides, the printer unit 17 includes a photoconductive drum, a laser and the like, the surface of the photoconductive drum is scanned and exposed by a laser beam from the laser, and an electrostatic latent image is formed on the photoconductive drum. A charger, a developing unit, a transfer unit and the like are disposed around the photoconductive drum, the electrostatic latent image of the photoconductive drum is developed by the developing unit, and a toner image is formed on the photoconductive drum. The toner image is transferred to a sheet by the transfer unit, and is further fixed to the sheet by the fixing unit. The structure of the printer 17 is not limited to the above example, and there are various systems.

The finisher 200 includes a staple mechanism 20 to staple a sheet bundle. Besides, a saddle unit (described later) to saddle-stitch sheets and to fold the sheets in half may be included.

The punch mechanism 90 disposed between the main body 11 and the finisher 200 includes a punch unit 91 and a dust box 92. Besides, rollers 19 and 93 for conveying a sheet are provided on a passage extending from the main body 11 to the finisher 200. The sheet ejected from the main body 11 is conveyed to the finisher 200 via the rollers 19 and 93. A punch process by the punch unit 91 is executed when the user operates the operation panel 13 and a punch mode is set.

Next, the finisher 200 will be described. FIG. 1 shows only the structure of the main part of the finisher 200, and FIG. 2 shows the detailed structure of the finisher 200.

Figure 2:
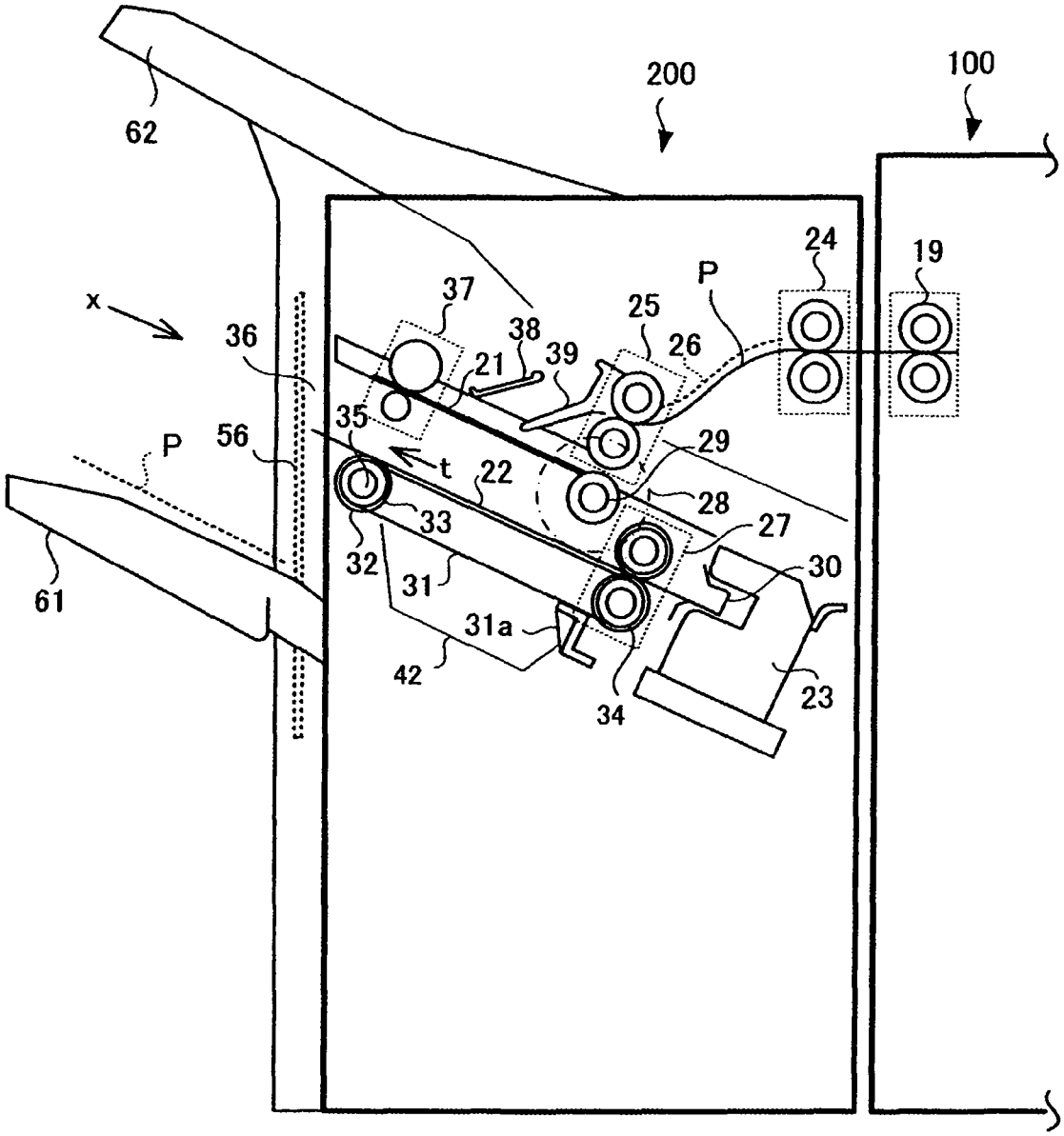
FIG. 2 is a side view showing the sheet finishing apparatus of the embodiment.

FIG. 2 is a structural view of the finisher 200. Incidentally, in FIG. 2, the punch mechanism 90 is omitted, and the description will be made on the assumption that the sheet P on which an image is formed by the MFP 100 is directly conveyed to the finisher 200.

The sheet P on which the image is formed by the MFP 100 is ejected from the eject roller 19, and is conveyed to the finisher 200. The discharge roller 19 includes an upper roller and a lower roller.

The finisher 200 includes a standby tray 21, a processing tray 22, and a stapler 23. Besides, the finisher includes a paper storage tray 61 and a fixed tray 62. The paper storage tray 61 can move up and down.

The sheep P ejected by the eject roller 19 of the MFP 100 is received by an inlet roller 24 provided near a carry-in port of the finisher 200. The inlet roller 24 includes an upper roller and a lower roller, and is driven by a motor MT1 (described later).

A paper feed roller 25 is provided at the downstream side of the inlet roller 24, and the sheet P received by the inlet roller 24 is fed to the standby tray 21 via the paper feed roller 25. The paper feed roller 25 includes an upper roller and a lower roller, and the paper feed roller 25 is also driven by the motor MT1.

A paper path 26 for guiding the sheet P to the paper feed roller 25 is provided between the inlet roller 24 and the standby tray 21. The processing tray 22 on which the sheet P falling from the standby tray 21 is loaded is disposed below the standby tray 21.

The standby tray 21 loads the sheet P and has an openable structure, and when a predetermined number of sheets P are stacked, the standby tray 21 is opened, and the sheets P fall to the processing tray 22 or by an operation of a falling assist member to enforce falling. The processing tray 22 aligns and supports the sheet P while the sheet P is stapled by the stapler 23.

The sheet falling on the processing tray 22 is guided to the stapler 23 by a roller 27, and is subjected to a stapling. The roller 27 includes an upper roller and a lower roller, and is driven by a motor MT7 (described later). Upon stapling, plural sheets P falling from the standby tray 21 to the processing tray 22 are aligned in a longitudinal direction as a conveying direction, and are aligned in a lateral direction perpendicular to the conveying direction, and the stapling is performed.

Besides, when the sheet P falls to the processing tray 22, a rotatable paddle 28 is disposed at a position where the trailing edge of the sheet P falls.

Figure 4A:
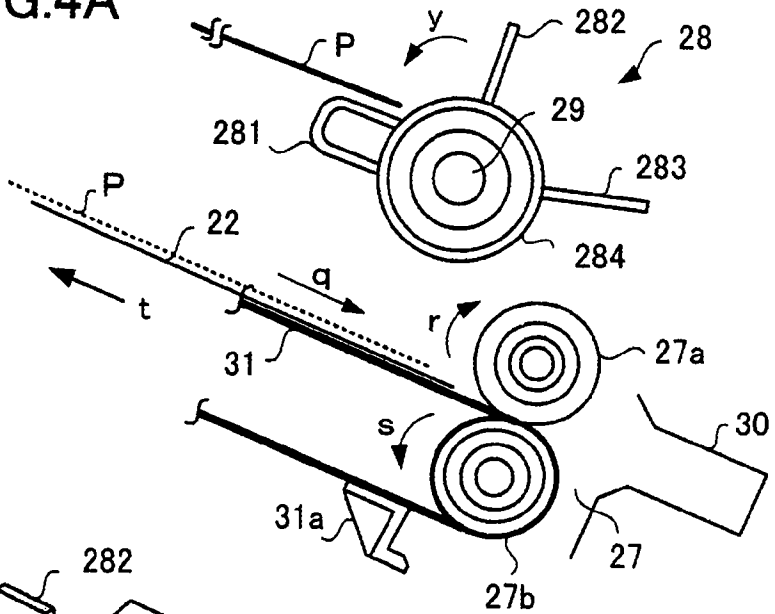
FIG. 4A is a side view for explaining the operation of a paddle used in the embodiment.
Figure 4B:
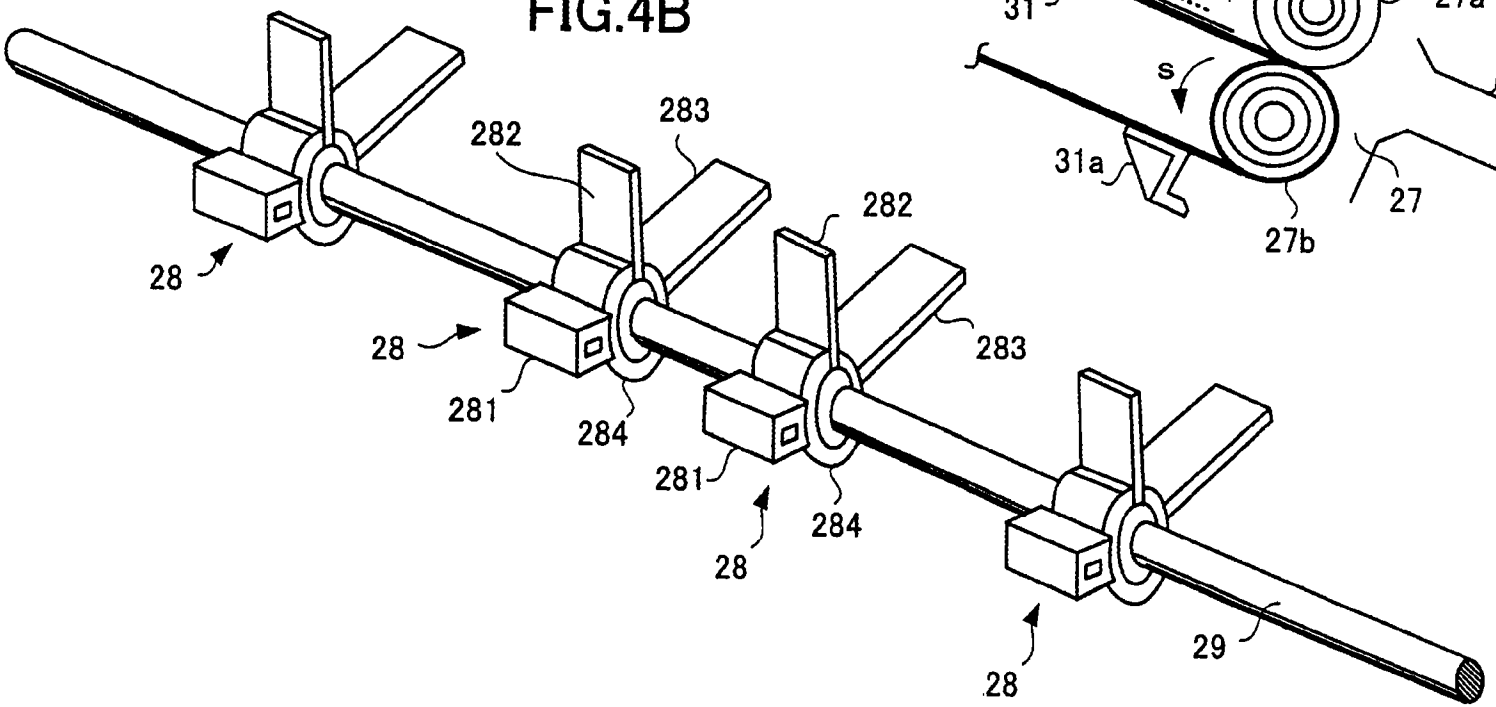
FIG. 4B is a perspective view of the paddle used in the embodiment.

The paddle 28 is attached to a rotation shaft 29, slaps the sheet P falling from the standby tray 21 onto the processing tray 22, and feeds the sheet P in the direction of the stapler 23. The details of the paddle 28 are shown in FIGS. 4A and 4B and will be described later.

A stopper 30 to regulate the trailing edge position of the sheet P is provided at the end of the processing tray 22 on the side of the stapler 23. Besides, a conveyor belt 31 and an eject roller 32 are provided in order to convey the sheet P subjected to the sorting or the stapling to the paper storage tray 61. The conveyor belt 31 is stretched between pulleys 33 and 34, and a pawl member 31*a* to hook and feed the trailing edge of the sheet P is attached to the conveyor belt 31.

The paper feed roller 25, the standby tray 21, the paddle 28, the lateral alignment device 40, and the processing tray 22 constitute a sheet introduction unit to guide the sheet P received by the inlet roller 24 to the finishing unit (stapler 23). Besides, the stapler 23 constitutes a finishing unit for stapling.

The lower roller of the roller 27 is disposed coaxially with the pulley 34, and the rotation directions of the roller 27 are opposite to each other between when the aligned sheet is guided in the direction of the stapler 23 and when the sheet P subjected to the stapling is ejected. The pulley 33 is attached to a shaft 35, and the plural eject rollers 32 are rotatably attached to the shaft 35.

The sheet P conveyed by the conveyor belt 31 is ejected from an ejection port 36 to the paper storage tray 61, and the paper storage tray 61 is moved up and down by a motor DM1 (described later) and receives the sheet P. The conveyor belt 31, the pawl member 31*a*, and the eject roller 32 constitute a sheet ejection unit to guide the sheet P subjected to the finishing to the ejection port 36.

Besides, there is also a case where the sheet P loaded on the standby tray 21 is not subjected to the stapling, but is ejected to the paper storage tray 61. In this case, the sheet P is not made to fall to the processing tray 22, but is ejected by a rotation roller 37. Besides, the sheet P not requiring the finishing can also be ejected to the fixed tray 62. Although a conveying path for guiding the sheet P to the fixed tray 62 is provided, its illustration will be omitted.

Figure 3:
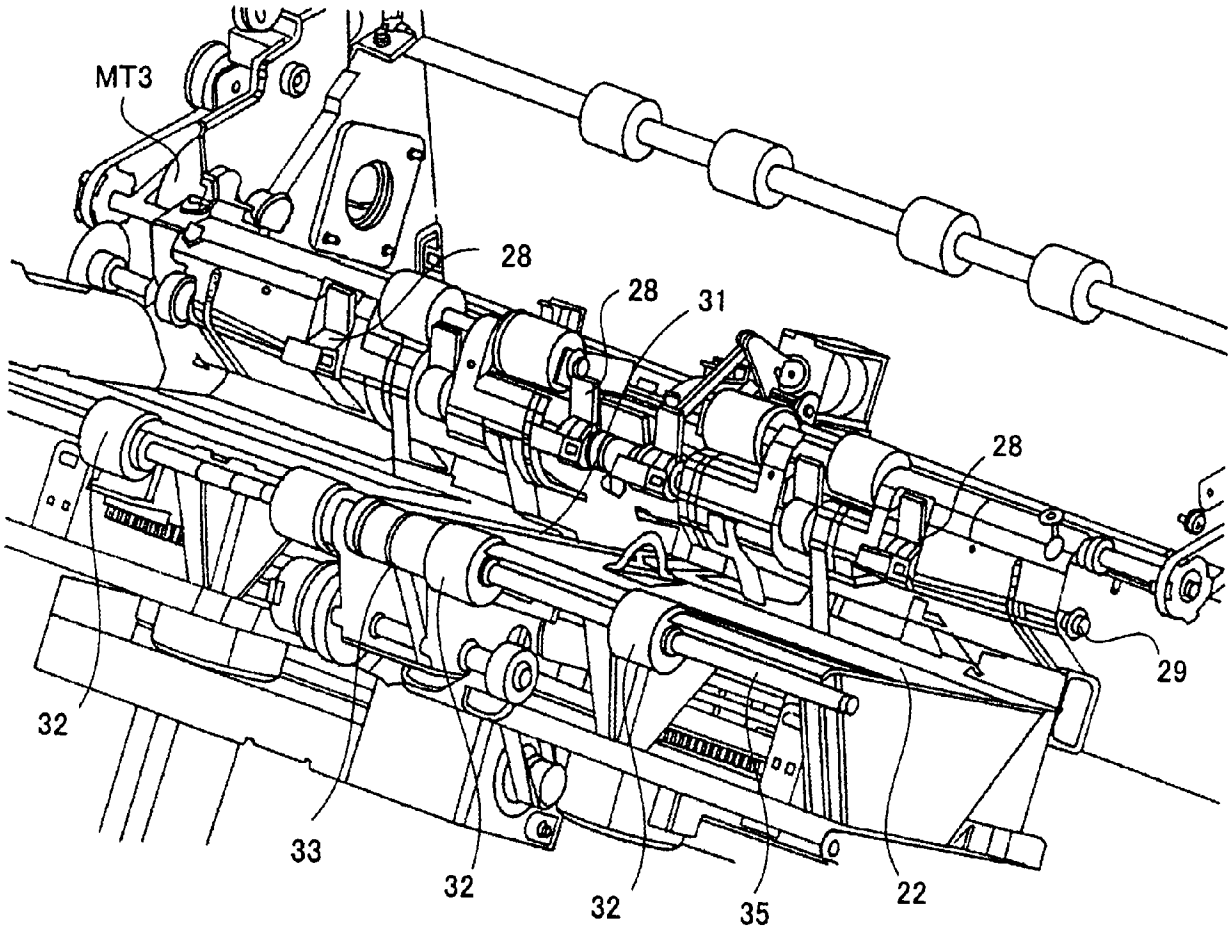
FIG. 3 is a perspective view showing the structure of the sheet finishing apparatus seen in a direction of an arrow x in FIG. 2.

FIG. 3 is a perspective view of a main part of the finisher 200, and is a view seen in a direction of an arrow x in FIG. 2.

In FIG. 3, the shaft 35 is disposed perpendicularly to the conveying direction of the sheet P, the pulley 33 is attached to an intermediate part of the shaft 35, and the conveyor belt 31 is stretched over the pulley 33. The conveyor belt 31 is stretched between the pulley 33 and the pulley 34 (FIG. 2), is rotated and driven by a motor MT8 (described later), and is circularly rotated and moved between the stapler 23 and the ejection port 36 along the eject direction of the sheet. The eject rollers 32 are attached to the center and both sides of the shaft 35, and are rotated when the sheet P is ejected to the paper storage tray 61.

FIG. 4A is an explanatory view for explaining the operation of the roller 27 for longitudinal alignment of the sheet P, the paddle 28 and the conveyor belt 31. As shown in FIG. 4A, when the sheet P is conveyed in the direction of the paper storage tray 61, the conveyor belt 31 moves in a direction of an arrow t, and an upper roller 27*a* and a lower roller 27*b* for longitudinal alignment are rotated in a direction of an arrow r and a direction of an arrow s in FIG. 4A.

The upper roller 27*a* for longitudinal alignment is rotated and driven by a motor MT7 (described later) and the lower roller 27*b* is rotated and driven by the motor MT8 for driving the conveyor belt 31.

The state of FIG. 4A is the home position of the paddle 28, and receives, at this position, the trailing edge of the sheet P falling from the standby tray 21.

The paddle 28 is attached to the rotation shaft 29, and the rotation shaft 29 is rotated and driven by a motor MT3 (described later). Alternatively, the rotation force of the motor may be transmitted to the rotation shaft 29 through a gear mechanism.

The paddle 28 rotates in a y-direction while the home position is made a base point, and the trailing edge of the sheet P received by a receiving unit 281 is slapped down by a slapping part 282 onto the processing tray 22, and is fed in the direction of the stapler 23 by a feed part 283.

If the sheet P on the processing tray 22 is fed in the direction (arrow q) of the stapler 23, the upper roller 27*a* of the roller 27 rotates counterclockwise, and the lower roller 27*b* rotates clockwise. If the sheet P on the processing tray 22 is ejected, the upper roller 27*a* rotates in the direction of the arrow r, and the lower roller 27*b* rotates in the direction of the arrow s.

FIG. 4B shows the total structure of the paddle 28. A plurality of the paddles 28 are attached to the rotation shaft 29, and each of the paddles 28 includes an attachment member 284 attached to the rotation shaft 29.

The reception part 281 to receive the trailing edge of the sheet P falling from the standby tray 21, the slapping part 282 to slap down the sheet P onto the processing tray 22, and the feed part 283 to feed the sheet P on the processing tray 22 in the direction of the stapler 23 are integrally provided on the attachment member 284. The slapping part 282 and the feed part 283 of the paddle 28 are made of a rubber member and have elasticity.

Figure 5:
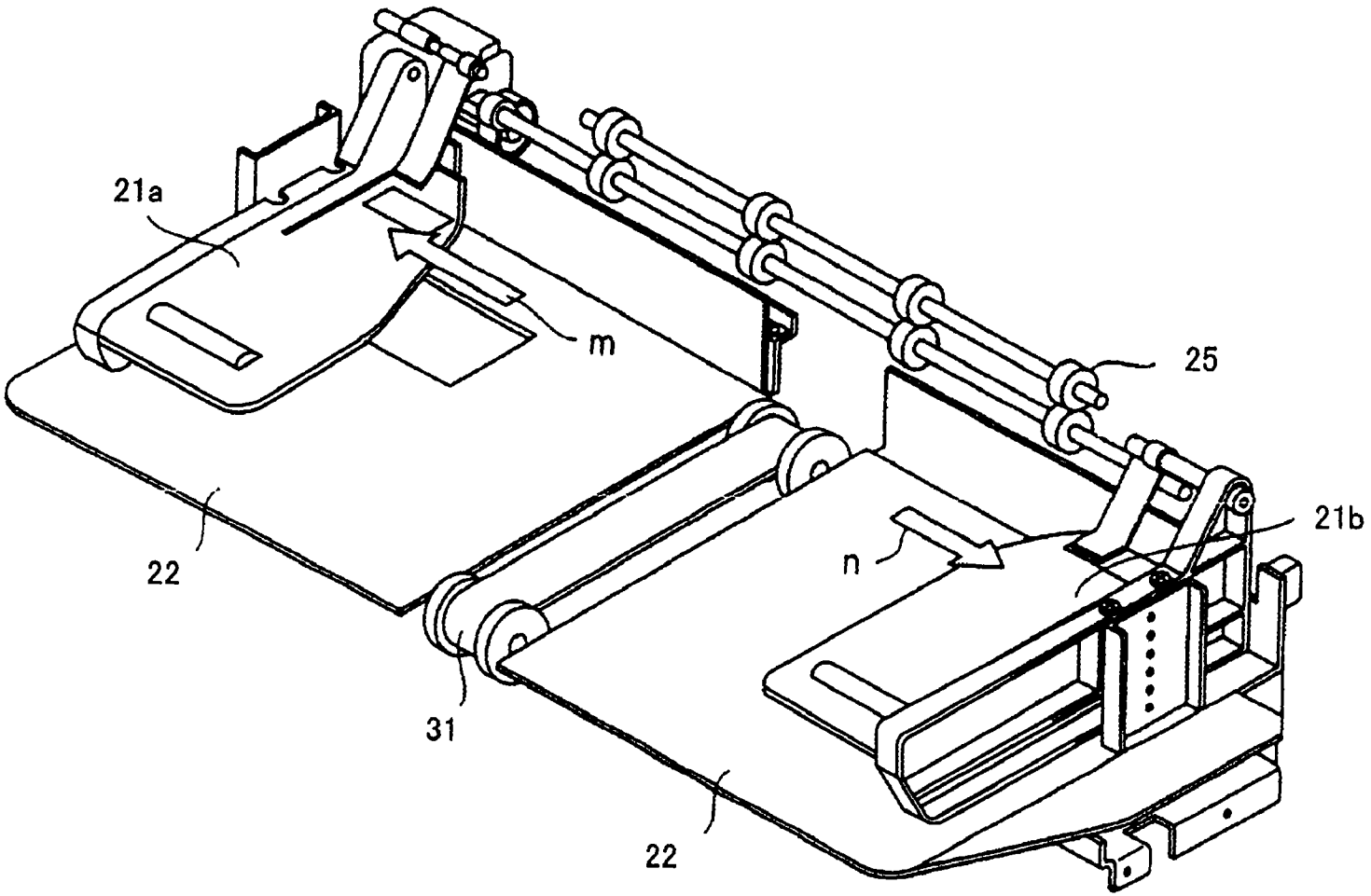
FIG. 5 is a perspective view showing a standby tray and a processing tray used in the embodiment.
Figure 6:
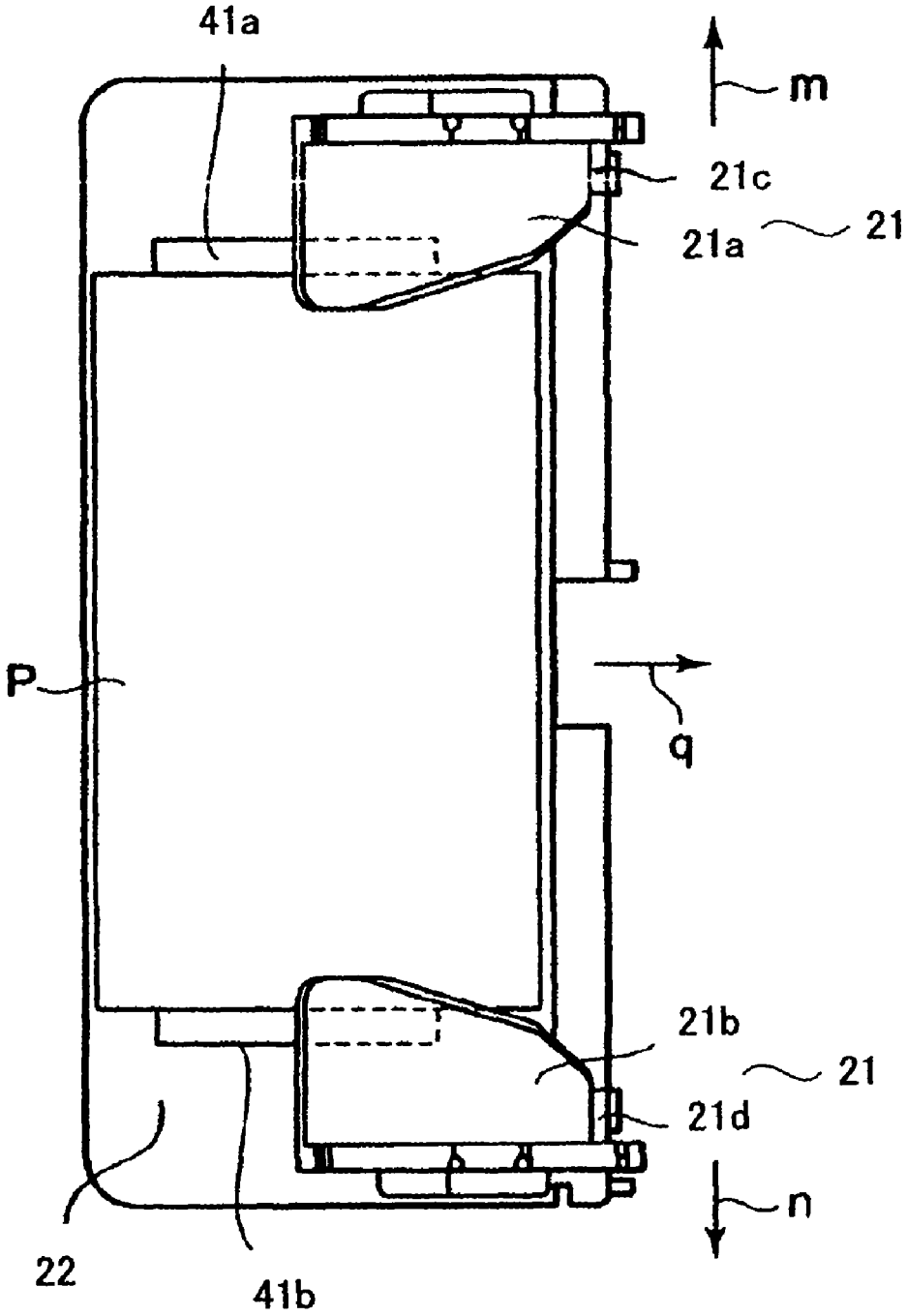
FIG. 6 is a plan view showing the standby tray and the processing tray used in the embodiment.

FIG. 5 and FIG. 6 schematically show the standby tray 21 and the processing tray 22, and the standby tray 21 includes a pair of tray members 21*a* and 21*b*, which receive the sheet P in a state where they are slid to the width of the sheet P, and support both sides of the sheet P. The tray members 21*a* and 21*b* are provided with stoppers 21*c* and 21*d* which regulate the trailing edge of the sheet P.

The standby tray 21 is slid and moved in the directions of arrows m and n by a motor MT2 (described later). When the sheet P on the standby tray 21 falls and is supplied to the processing tray 22, there is a case where the sheet p is disturbed in the lateral direction perpendicular to the conveying direction between the standby tray 21 and the processing tray 22.

Figure 7:
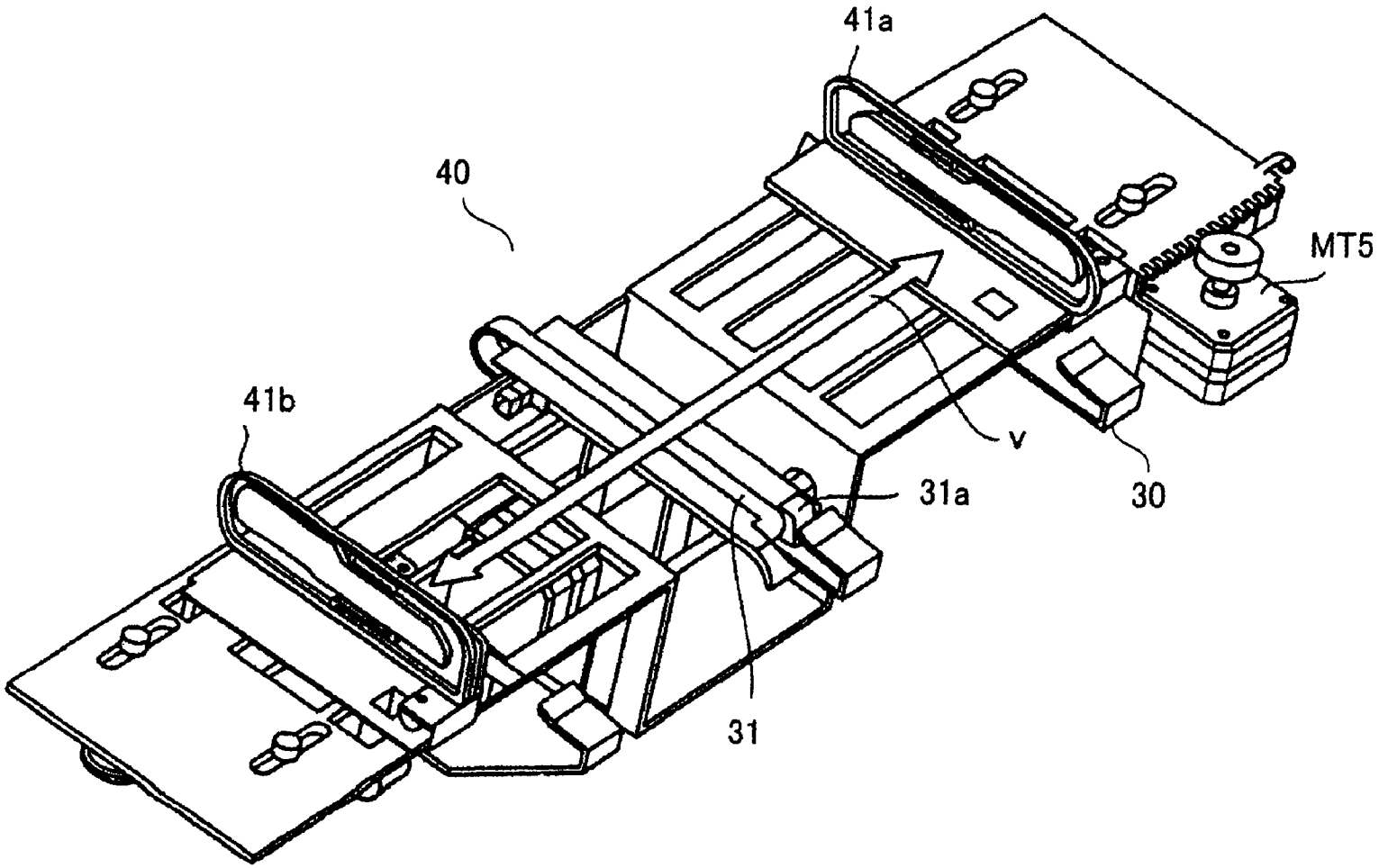
FIG. 7 is a perspective view showing an alignment device used in the embodiment.

Thus, as shown in FIG. 7, a lateral alignment device 40 to prevent the disturbance of the sheet P is provided. The lateral alignment device 40 includes a pair of lateral alignment plates 41*a* and 41*b*, and the lateral alignment plates 41*a* and 41*b* can be slid in a v direction by motors MT5 and MT6 (motor MT6 is omitted in FIG. 7) so as to conform to the width of the sheet P, and the alignment position can be changed.

Besides, the lateral alignment device 40 is provided with the stopper 30 to regulate the trailing edge position of the sheet P. Besides, in the lateral alignment device 40, when the lateral alignment plates 41*a* and 41*b* are slid and controlled in the v direction, the position of the sheet can be shifted, and the lateral alignment plates 41*a* and 41*b* are used also when the sheet P is sorted and ejected.

In this case, the lateral alignment plates 41*a* and 41*b* and the motors MT1 and MT6 to slide them to shift the position of the sheet P constitute a finishing unit for sorting.

Figure 8:
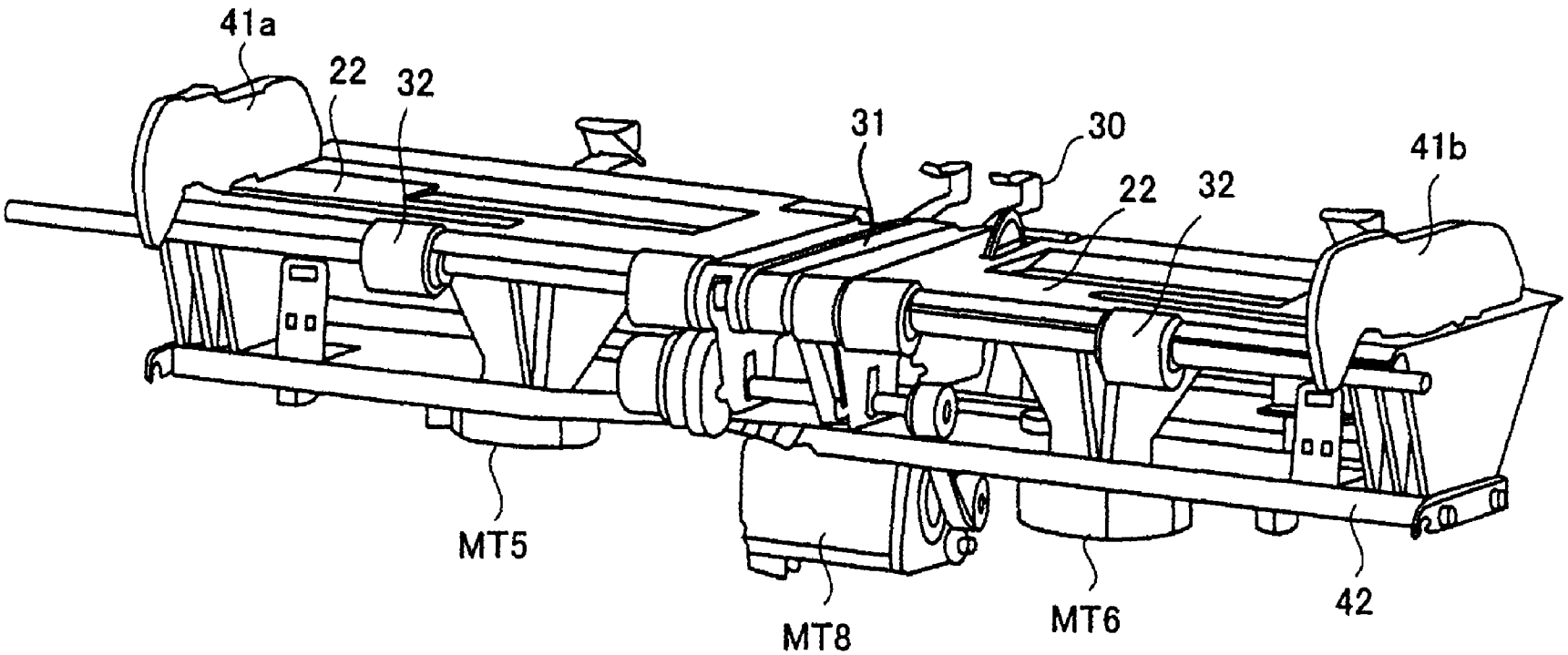
FIG. 8 is a perspective view showing the structure of a peripheral part of the processing tray and a conveyor belt used in the embodiment.

FIG. 8 is a perspective view showing the structure of the peripheral part of the processing tray 22, the conveyor belt 31 and the eject rollers 32. FIG. 8 shows also attachment positions of the motor MT8 to drive the conveyor belt 31 and the motors MT5 and MT6 to drive the lateral alignment plates 41*a* and 41*b*. The motors MT5 and MT6 and the motor MT8 are attached to a frame 42, and there is a space between the frame 42 and the processing tray 22.

Figure 9:
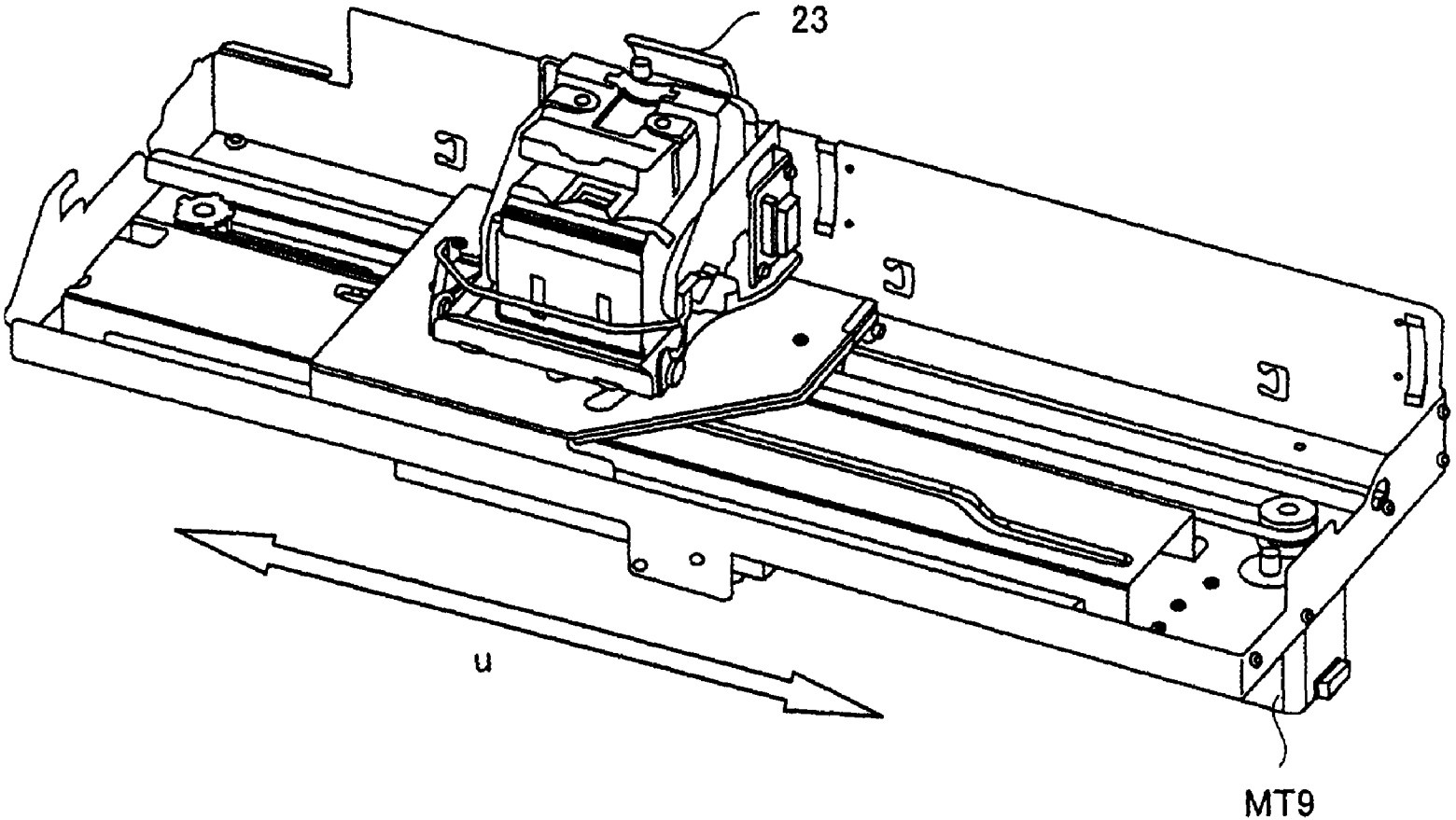
FIG. 9 is a perspective view showing a stapler used in the embodiment.

FIG. 9 is a view showing the structure of the stapler 23. The stapler 23 can slide in a u direction by a motor MT9, and when stapling is performed, the stapler moves along the trailing edge of the sheet P, and performs the stapling at a specified position. Besides, stapling is performed by a staple motor (not shown).

Figure 10:
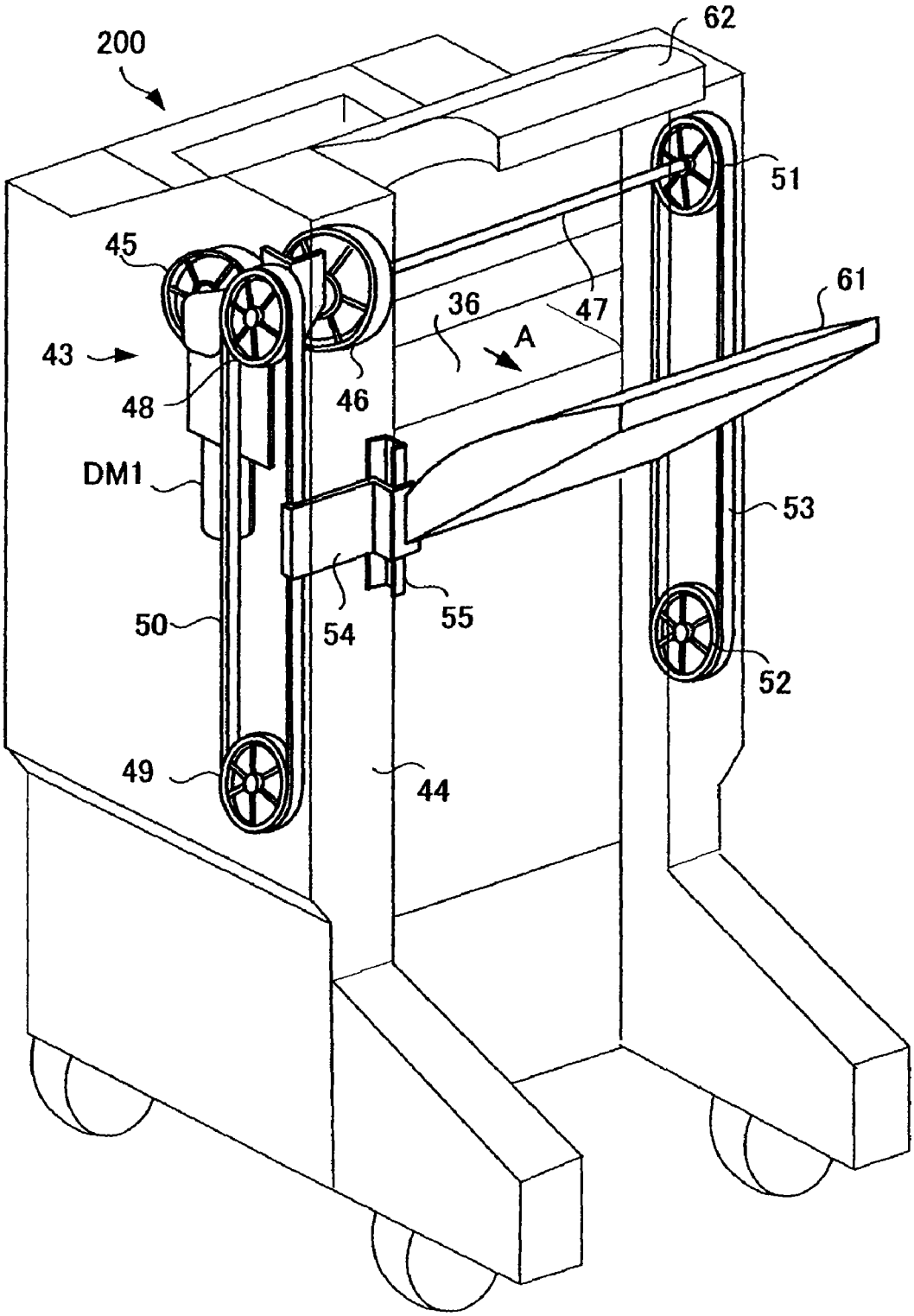
FIG. 10 is a perspective view showing a lifting and lowering mechanism of a paper storage tray used in the embodiment.

FIG. 10 is a perspective view showing a lifting and lowering mechanism of the movable paper storage tray 61. In FIG. 10, the outer appearance of the finisher 200 is indicated by a thin line, and the lifting and lowering mechanism 43 of the paper storage tray 61 is indicated by a thick line. Incidentally, the lifting and lowering mechanism 43 is actually covered with a housing (cover) 44 of the finisher 200. The lifting and lowering mechanism 43 includes a ratchet gear 45 driven by the drive motor DM1, and the ratchet gear 45 transmits drive force to a gear 46.

The gear 46 is attached to a rotation shaft 47, and a pulley 48 is attached to one end of the rotation shaft 47. The pulley 48 is connected to a lower pulley 49 through a belt 50, and the pulley 49 is rotated with the rotation of the pulley 48, and moves the belt 50 in an up-and-down direction.

Besides, a pulley 51 is attached to the other end of the rotation shaft 47, the pulley 51 is connected to a lower pulley 52 through a belt 53, and the pulleys 51 and 52 are rotated with the rotation of the pulley 48, and move the belt 53 in the up-and-down direction.

A base part of the paper storage tray 61 is attached to between the belts 50 and 53 by a bracket 54, and the paper storage tray 61 can move up and down along a rail 55 by the movement of the belts 50 and 53. Incidentally, although the rail 55 has a shape long in the lifting and lowering direction, FIG. 10 shows only a part thereof.

In FIG. 10, the sheet is ejected from the ejection port 36 of the finisher 200 in a direction of an arrow A, and is loaded on the paper storage tray 61. Alternatively, the sheet ejected upward is ejected to the fixed tray 62.

Figure 11A:
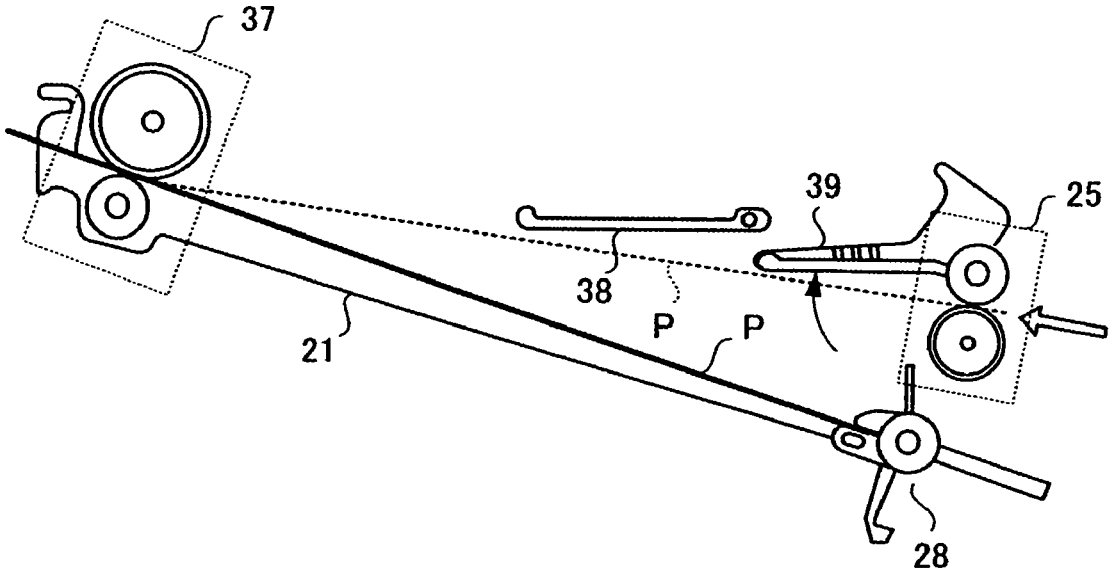
FIG. 11A and FIG. 11B are side views for explaining the operation of a bias arm used in the embodiment.
Figure 11B:
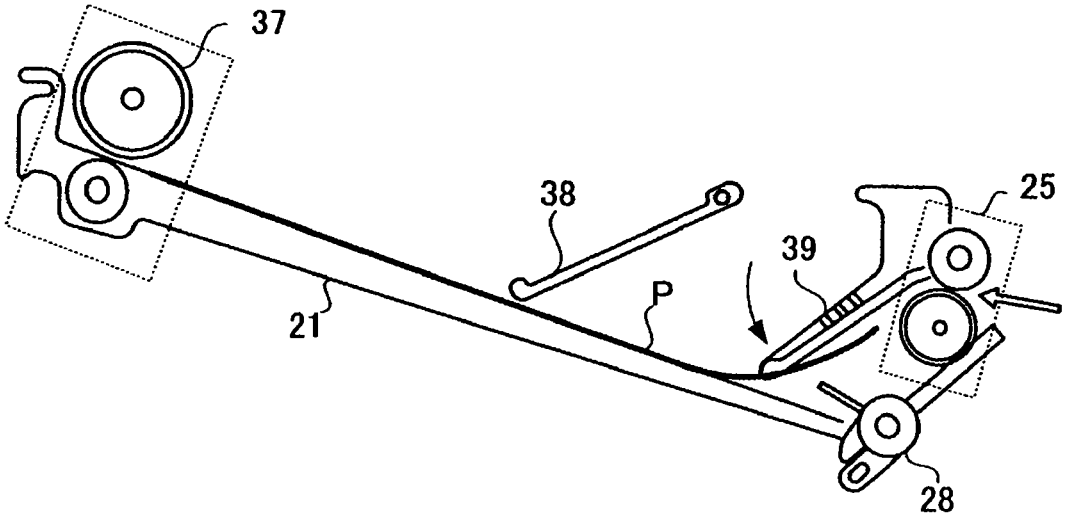

FIG. 11A and FIG. 11B are side views showing the structure of a sheet feed unit to the standby tray 21.

As described before, in the finisher 200, when plural sheets P are guided to the processing tray 22, they are temporarily loaded on the standby tray 21. At this time, it is necessary that the sheet P first loaded on the standby tray 21 is not pushed out by a later conveyed sheet. Besides, when the sheet P is curled, the paddle 28 may run idle.

Then, in order to accurately feed sheets to the standby tray 21, a guide arm 38 and a bias arm 39 (see FIG. 2) shown in FIGS. 11A and 11B are provided.

That is, although the sheet P is conveyed to the standby tray 21 via the paper feed roller 25, the swingable guide arm 38 is provided on the side of the trailing edge of the sheet P. The guide arm 38 regulates the movement and posture of the sheet P fed from the paper feed roller 25 to the standby tray 21.

In general, in the sheet P one side of which is printed, since ink is contracted, when the printed surface is directed downward, the sheet P is curled upward. Then, the guide arm 38 serves to suppress the curl of the sheet P.

Further, the bias arm 39 is rotatably supported to an attachment shaft of the paper feed roller 25. The bias arm 39 protrudes to the eject side of the paper feed roller 25, and functions as pusher to push the sheet to the standby tray 21 so that the trailing edge side of the sheet P conveyed from the paper feed roller 25 does not rise.

In order to drive the bias arm 39, a motor MT10 (described later) is used. Besides, the rotation roller 37 is provided in the traveling direction of the sheet ejected from the paper feed roller 25, and is used for conveying the sheet P to the paper storage tray 61, and a motor MT4 (described later) is used in order to drive the rotation roller 37.

In FIG. 11A, the sheet P is conveyed in the direction of the rotation roller 37 by the paper feed roller 25. At this time, the rotation roller 37 rotates in the direction of conveying the leading edge of the sheet. Since the sheet P has firmness (rigidity), the guide arm 38 is swung upward (clockwise direction in the drawing). At this time, the bias arm 39 is rotated upward, and the sheet P is guided in the straight direction and advances.

The sheet P is guided in the straight direction as indicated by a dotted line and advances, and when the trailing edge of the sheet P comes away from the paper feed roller 25, the rotation of the paper feed roller 25 is stopped. Then, the paddle 28 is rotated, and assists the trailing edge of the sheet P in falling.

Next, as in FIG. 11B, the bias arm 39 is rotated downward, and the leading edge thereof pushes down the sheet P. By this, the trailing edge of the sheet P is pushed to the standby tray 21 side. Besides, the leading edge of the guide arm 38 is similarly lowered, and the sheet P can be surely held by the bias arm 39 and the guide arm 38.

In this state, the paddle 28 is rotated, and the sheet is slapped down by the slapping part 282 onto the processing tray 12 and is guided to the processing tray 22.

Incidentally, a transmission mechanism is provided between the motor MT10 to drive the bias arm 39 and the bias arm 39, and control can be performed such that the bias arm 39 is rotated downward by the reverse rotation of the motor MT10.

Besides, although the finisher 200 can staple the sheet by the stapler 23, the user uses the stapler 23 and can also staple by manual operation.

That is, the user inserts sheets to the processing tray 22 through the ejection port 36, and presses a manual operation button to operate the stapler 23, and stapling can be performed.

Besides, in the finisher 200, in order to prevent a foreign material or dust from entering from the outside, a shutter 56 is provided so as to block the ejection port 36 (see FIG. 2). The shutter 56 is in an open state while the finisher 200 is operating, and is in a closed state while the finisher 200 is not operating or when the sheet P is ejected to the fixed tray 62. A motor MT11 (described later) is used for controlling the opening and closing of the shutter 56.

Figure 12B:
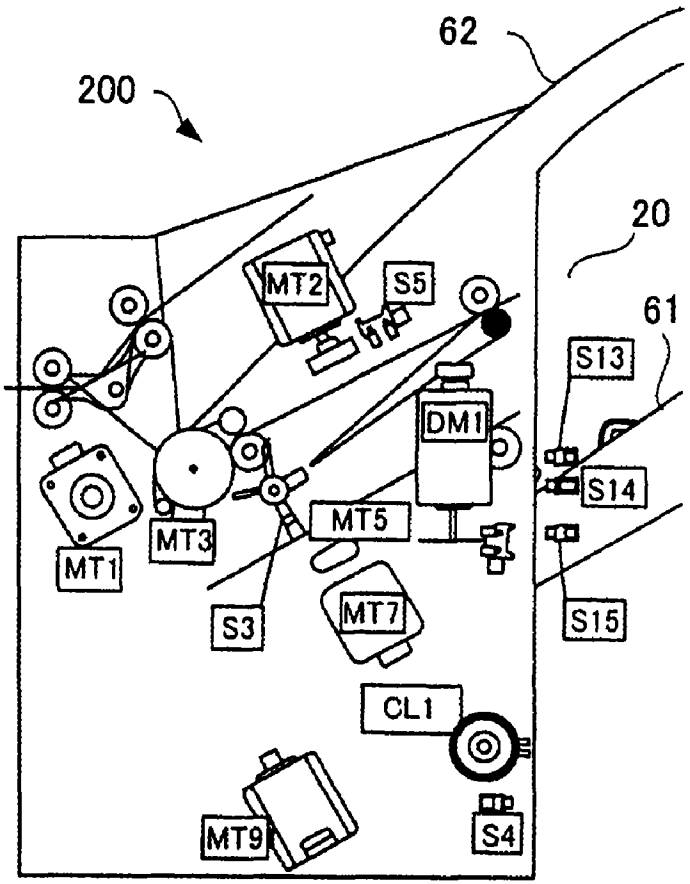
FIG. 12A and FIG. 12B are explanatory views showing the arrangement of various motors used in the embodiment.
Figure 12A:
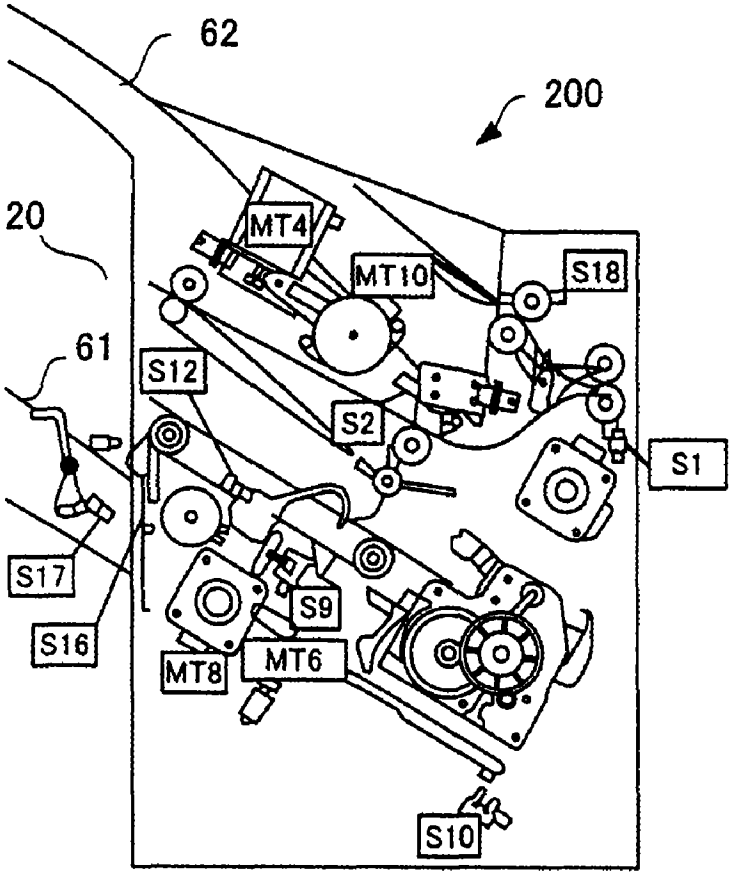

FIG. 12A and FIG. 12B are arrangement views of the motors to drive the respective devices of the finisher 200. FIGS. 12A and 12B are side views in which the finisher 200 is viewed from different directions, and show the schematic arrangement of the motors MT1 to MTn.

Incidentally, the respective devices of the finisher 200 mean devices provided between the inlet roller 24 and the storage tray 61. For example, they correspond to the inlet roller 24, the paper feed roller 25, the standby tray 21, the processing tray 22, the stapler 23, the paddle 28, the roller 27, the conveyor belt 31, the eject roller 32, the lateral alignment device 40, the paper storage tray 61, the lifting and lowering mechanism 43 and the like.

In FIGS. 12A and 12B, MT1 is the motor to drive the inlet roller 24 and the paper feed roller 25, and MT2 is the motor to drive the standby tray 21. MT3 is the motor to rotate the paddle 28, and MT4 is the motor to rotate the rotation roller 37.

Besides, MT5 is the motor to drive the lateral alignment plate 41*a*, MT6 is the motor to drive the lateral alignment plate 41*b*, and MT7 is the motor to drive the upper roller 27*a* for longitudinal alignment. Besides, MT8 is the motor to drive the conveyor belt 31, MT9 is the motor to move the stapler 23, and MT10 is the motor to drive the bias arm 39. Further, DM1 is the motor to lift and lower the paper storage tray 61. Besides, CL1 is a clutch to open and close the shutter 56.

The motors M1 to M10 and DM1 are controlled by a control unit (described later). The powers of the motors M1 to M10 and DM1 are actually transmitted to the respective devices through a transmission mechanism such as a gear or a belt, and these motors and the transmission mechanism constitute a drive unit to drive the respective devices. Incidentally, the details of the transmission mechanism will be omitted.

Next, the operation of the finishing by the finisher 200 will be described along the flow of a sheet.

In a normal mode, that is, in the mode in which the sheet is conveyed and the finishing is performed, as shown in FIG. 2, the sheet P conveyed from the inlet roller 24 is supplied onto the standby tray 21 by the paper feed roller 25. The sheet P temporarily placed on the standby tray 21 next falls onto the processing tray 22.

At the time of falling of the sheet P, the reception part 281 of the paddle 28 receives the trailing edge of the sheet P. The sheet falls while both sides of the sheet P are in contact with the lateral alignment plates 41*a* and 41*b*, and the alignment in the lateral direction is performed.

Next, the paddle 28 is rotated in a direction of an arrow y as shown in FIG. 4A, and the trailing edge of the sheet P falls from the reception part 281, and is slapped down onto the processing tray 22 by the slapping part 282. Further, the paddle 28 feeds the sheet P in the direction of the arrow q by the feed part 283, the trailing edge of the sheet P is abutted against the stopper 30, and the alignment of the sheet P in the longitudinal direction is completed.

In this way, the sheet P on which an image is formed is guided from the paper feed roller 25 to the processing tray 22 while the alignment is sequentially performed in the lateral direction and the longitudinal direction.

Upon stapling, when the number of sheets P placed on the processing tray 22 reaches a specified number, the stapler 23 staples the sheets P on the processing tray 22 at a desired position, and forms a sheet bundle. Thereafter, as shown in FIG. 4A, the sheet bundle is nipped between the upper roller 27*a* rotating in the direction of the arrow r and the lower roller 27*b* rotating in the direction of the arrow s, and is conveyed in the direction of the paper storage tray 61.

When passing through the rollers 27*a* and 27*b*, the trailing edge of the sheet bundle is hooked by the feed pawl 31*a* of the conveyor belt 31 rotated in the direction of the arrow t, is conveyed toward the paper storage tray 61, and then is ejected onto the paper storage tray 61 by the eject roller 32.

Besides, the sheets can be shifted in the width direction by operating the lateral alignment plates 41*a* and 42*b*, and the sheets can be sorted and ejected.

Although the operation of the normal mode of the sheet finishing apparatus 200 is described, next, a description will be given to the structure for reducing noise at the time of trial operation.

The finisher 200 performs the trial operation to confirm whether the respective devices normally operate or not. The finisher 200 may perform the trial operation when the power is turned on, when the finisher 200 changes from a power saving mode to a normal mode, and when the finisher 200 is released from a jam state in which a sheet is lodged in the inside of the finisher 200. The trial operation is performed before the sheet P is conveyed from the MFP 100 (that is, in the state where there is no sheet P).

Figure 13A:
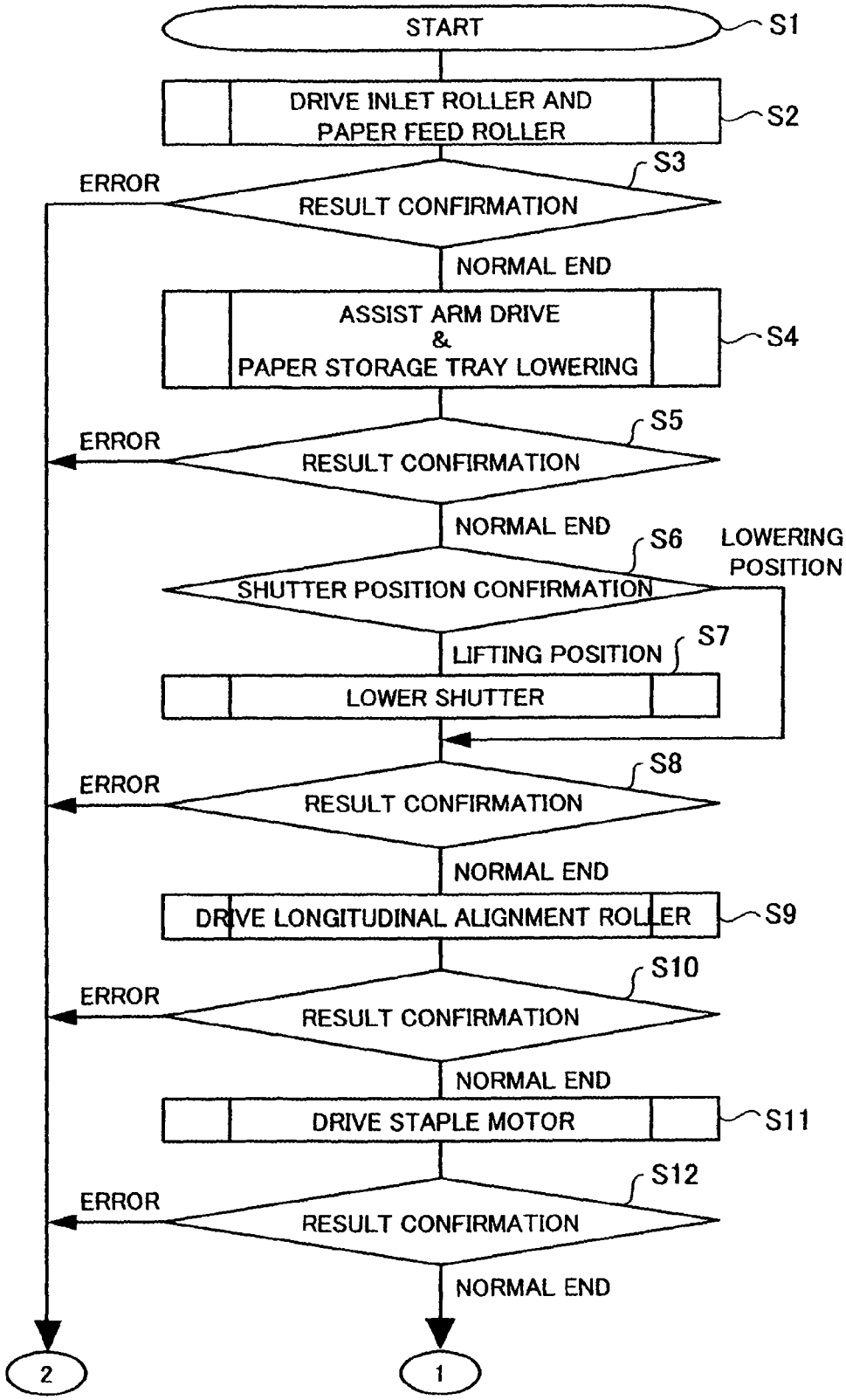
FIG. 13A and FIG. 13B are flowcharts at the time of trial operation of the sheet finishing apparatus of the embodiment.
Figure 13B:
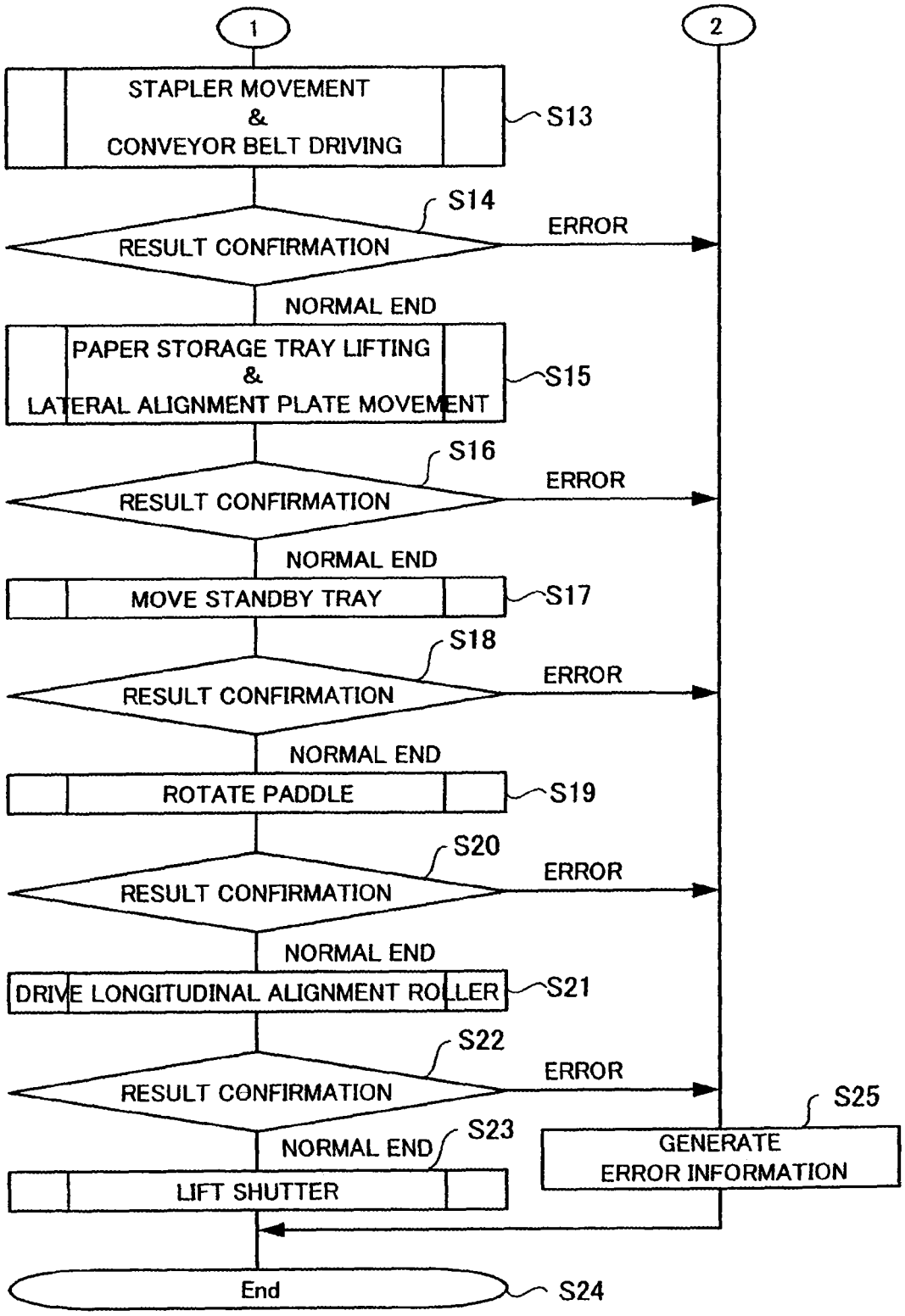

FIG. 13A and FIG. 13B show an example of a flowchart when the respective devices are operated for trail.

In FIG. 13A, step S1 is a start step of the trial operation, and at step S2, the inlet roller 24 and the paper feed roller 25 are rotated by the motor MT1, and at step S3, it is confirmed whether the inlet roller 24 and the paper feed roller 25 are normally driven or not.

At next step S4, the motor MT10 and the motor DM1 are rotated to drive the bias arm 39 and to perform the lowering operation of the paper storage tray 61, and at step S5, it is confirmed whether the bias arm 39 and the paper storage tray 61 are normally driven or not.

Step S6 is a step of confirming the position of the shutter 56, and when the shutter 56 is at a lifting position (closed), the shutter 56 is lowered at step S7, and when the shutter is at a lowering position at step S6, a shift is made step S8. At step S8, it is confirmed whether the operation of the shutter 56 is normal or not.

At step S9, the motor MT7 is rotated, and the longitudinal alignment roller 27 is forwardly rotated. At step S10, it is confirmed whether the rotation of the longitudinal alignment roller 27 is normal or not.

At step S11, a stapler motor (not shown) is rotated to operate the stapler 23, and at step S12, it is confirmed whether the operation of the stapler 23 is normal or not.

Next, a shift is made to step S13 of FIG. 13B, the motor MT9 is rotated to move the stapler 23, and the conveyor belt 31 is rotated by the motor MT8 At step S14, it is confirmed whether the movement of the stapler 23 and the driving of the conveyor belt 31 are normal or not.

At step S15, the motor DM1 is rotated to lift the paper storage tray 61, and the motors MT5 and MT6 are rotated to move the lateral alignment plates 41*a* and 41*b*. At step S16, it is confirmed whether the lifting operation of the paper storage tray 61 and the driving of the lateral alignment plates 41*a* and 41*b* are normal or not.

At step S17, the motor MT2 is rotated to move the standby tray 21. At step S18, it is confirmed whether the driving of the standby tray 21 is normal or not.

At step S19, the paddle 28 is rotated by the motor MT3. At step S20, it is confirmed whether the rotation of the paddle 28 is normal or not.

Further, at step S21, the longitudinal alignment roller 27 is reversely rotated by the motor MT7. At step S22, it is confirmed whether the rotation of the longitudinal alignment roller 27 is normal or not.

At step S23, the shutter 56 at the lowering position is lifted, and the process is ended at step S24.

Incidentally, if an abnormality is confirmed at the confirmation step of each of the steps S3, S5, S8, S10, S12, S14, S16, S18, S20 and S22 of FIGS. 13A and 13B, error information is generated at step S25, and an error place is notified to the user.

In this way, in the trial operation, the respective motors are sequentially driven to drive (move, rotate, lift or lower) the respective devices, it is confirmed where they are normally operated or not, and then, the finisher 200 enters a usable state.

Figure 14:
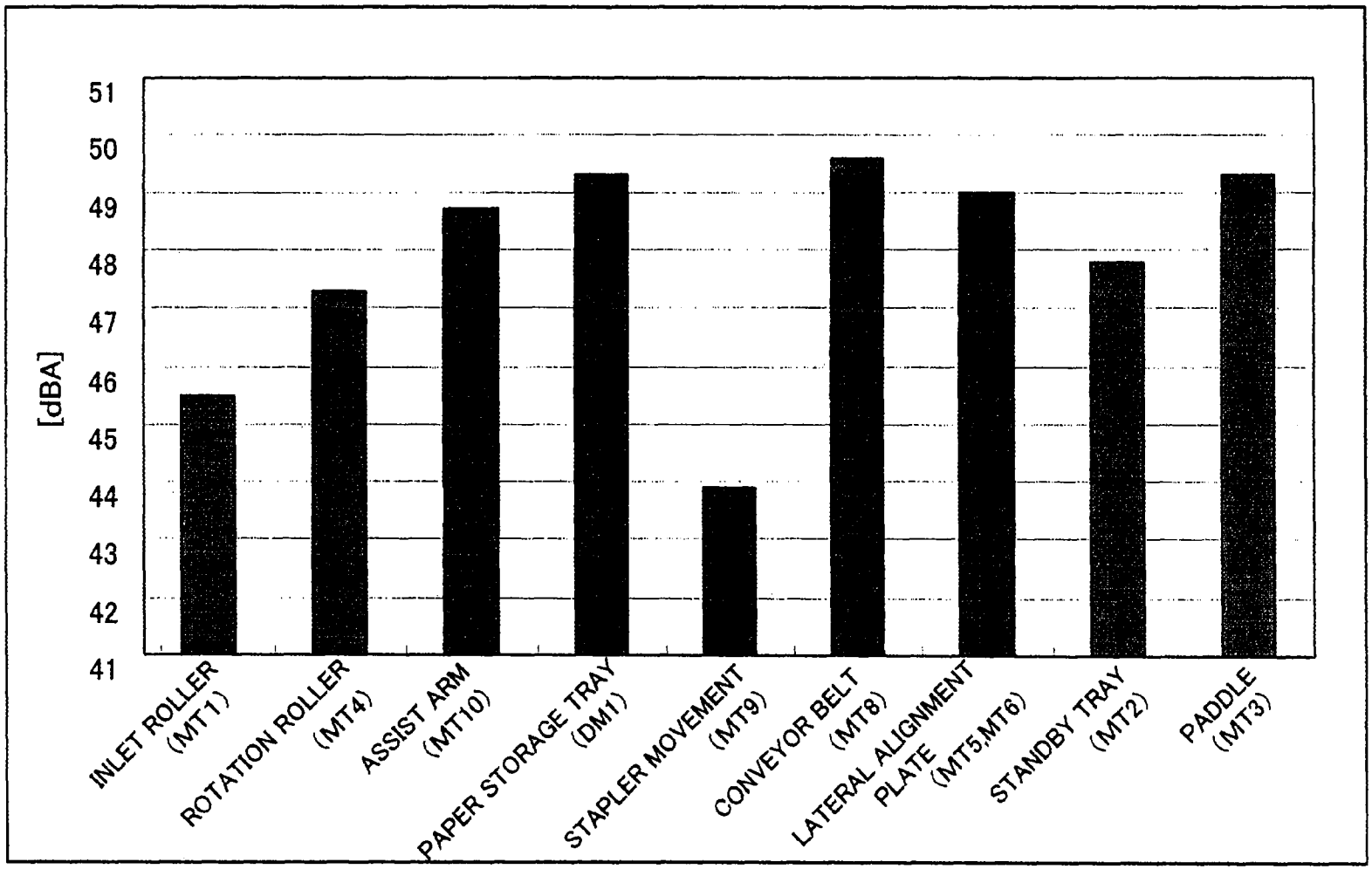
FIG. 14 is a characteristic view showing sound pressure levels of various motors used in the embodiment.

FIG. 14 is a characteristic view showing measurement results of sound pressure levels of the drive motors when the respective devices are driven.

As is understood from FIG. 14, motors with sound pressure levels not less than 40 [dBA] include the motors to drive the inlet roller 24, the rotation roller 37, the bias arm 39, the paper storage tray 61, the stapler 23, the conveyor belt 31, the lateral alignment plates 41*a* and 41*b*, the standby tray 21, and the paddle 28.

Especially, since the motor DM1 for the paper storage tray 61 has a high sound pressure level and a long operation time, it becomes an offensive noise source. Similarly, the motors MT8 and MT3 to drive the conveyor belt 31 and the paddle 28 also become offensive noise sources.

Then, a measure to reduce the noise may be taken as described below.

That is, when a motor operates which has a sound pressure level not less than a previously set reference level (49 [dBA] or more in the example of FIG. 14), a motor with a low sound pressure level is operated. By this, the operation sound of the motor with the low sound pressure level is masked by the operation sound when the motor with the high sound pressure level operates, and the offensive sound can be reduced.

For example, the operation timings of the respective motors are controlled, so that, during the lowering operation of the paper storage tray 61, the bias arm 39 and the rotation roller 37 with the sound pressure level lower than that are operated. Besides, during the lifting operation of the paper storage tray 61, the lateral alignment plates 41*a* and 41*b* with the sound pressure level lower than that are operated. Similarly, during the operation of the conveyor belt 31, the stapler 23 is moved.

Incidentally, another device (for example, the paddle 28) with a high sound pressure level is operated after the operation of the paper storage tray 61 or the conveyor belt 31 is ended.

In this way, the sound of a device, which is offensive to the ear when it singly operates, can be masked.

Besides, motors with high sound pressure levels include the motors (DM1, MT8, MT3) to drive the paper storage tray 61, the paddle 28, and the conveyor belt 31.

Figure 15A:
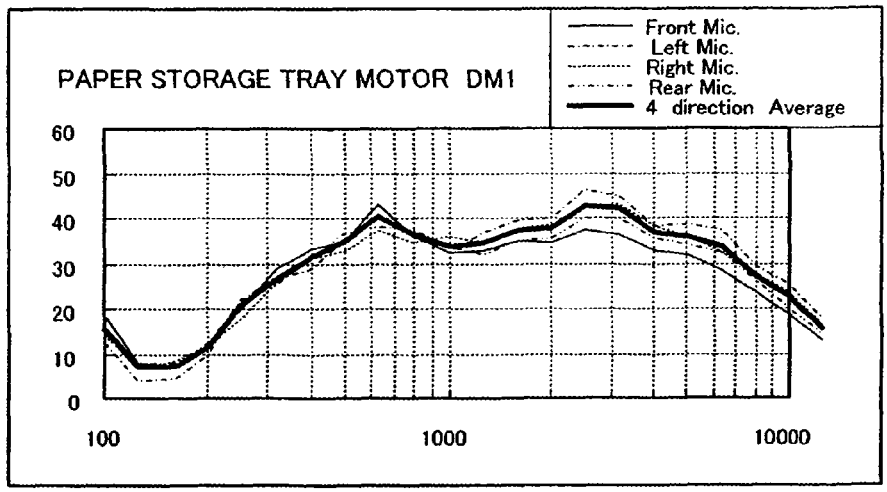
FIGS. 15A, 15B and 15C are characteristic views of frequencies and noise levels of various motors used in the embodiment.
Figure 15B:
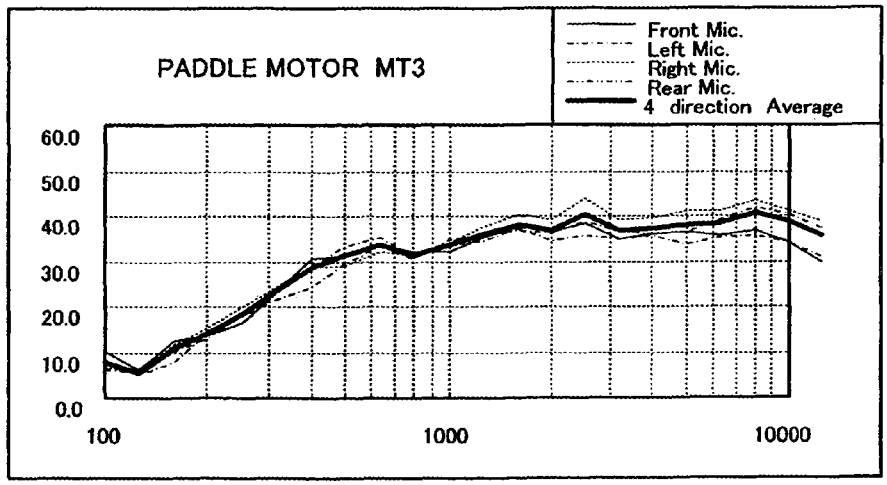
Figure 15C:
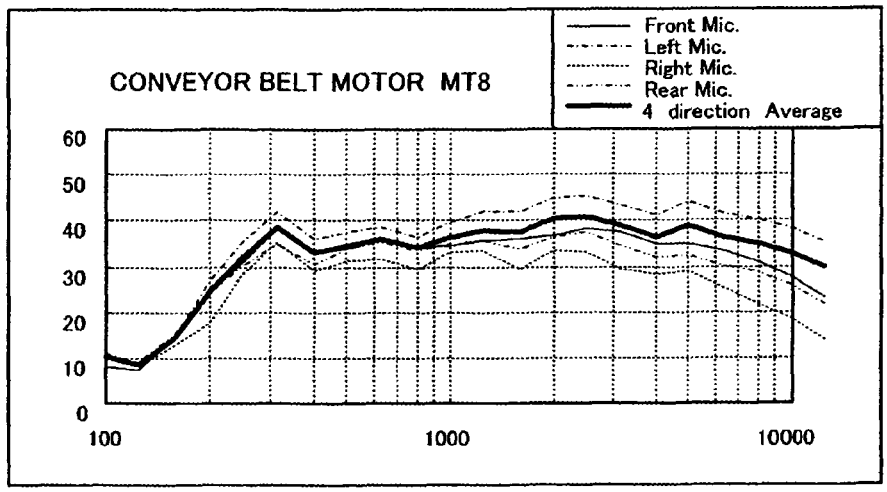

FIGS. 15A, 15B and 15C are characteristic views showing measurement results of sound pressure levels of the motor DM1 to drive the paper storage tray 61, the motor MT3 to drive the paddle 28, and the motor MT8 to drive the conveyor belt 31. The vertical axis indicates the sound pressure level [dBA], and the horizontal axis indicates the frequency (Hz).

The measurement is performed such that respective motor sounds are measured by microphones arranged at the front surface part (Front mic.), the left side (Left mic.), the right side (Right mic.) and the rear surface part (Rear mic. ) of the finisher 200, and an average value (4-direction Average) thereof is obtained. Incidentally, FIGS. 15A, 15B and 15C show the results of the measurement by the noise measurement method and the microphone installation method in accordance with the standards of ISO 7779.

For example, the motor DM1 to drive the paper storage tray 61 has a high sound pressure level at 2 to 3 kHz. Besides, the motor MT3 to drive the paddle 28 has a frequency band with a high sound pressure level in addition to the 2 to 3 kHz band. Besides, it is understood that the motor MT8 to drive the conveyor belt 31 has a high sound pressure level at a frequency band other than the 2 to 3 kHz band.

Accordingly, when the paddle 28 and the conveyor belt 31 are simultaneously driven during the operation of the paper storage tray 61, the sound pressure level becomes high in a wide frequency band by the combination thereof. Thus, the paper storage tray 61, the paddle 28 and the conveyor belt 31 are driven at shifted timings so that they are not simultaneously operated for trial.

Further, when a large sound is suddenly generated by the trial operation, the user is surprised. Then, the drive motor MT8 for the conveyor belt 31 having the largest sound pressure level is not operated first. For example, before the conveyor belt 31 is driven, the inlet roller 24 is operated. Alternatively, the motor MT9 is driven to move the stapler 23.

Besides, the drive motor DM1 for the paper storage tray 61 having the longest operation time is not operated first. For example, before the paper storage tray 61 is operated, the motor MT1 with a motor operation time shorter than that is driven to operate the inlet roller 24.

By this, the noise at the time of the trial operation can be reduced.

Besides, as a device close to the MFP 10, the inlet roller 24 exists. Since the drive motor MT1 for the inlet roller 24 operates at a constant frequency, the sound is a single tone and the sound pressure level is low. On the other hand, the sound of the MFP 10 at the time of the trial is a complex tone, and the sound pressure level is higher than the driving sound of the inlet roller 24, and accordingly, the masking effect can be obtained by operating the device closer to the MFP 10 first.

Accordingly, the offensive sound can be reduced by operating the device closer to the MFP 10.

For example, the inlet roller 24 is first operated, and then, the bias arm 39, the rotation roller 37, and the paper storage tray 61 are sequentially operated toward the eject direction of the sheet. Next, the operation is performed in the order of the conveyor belt 31, the stapler 23, the lateral alignment plates 41*a* and 41*b*, the standby tray 21, and the paddle 28.

Besides, a device whose operation is not seen from the user may be first operated. For example, the operation of the drive motor MT1 for the inlet roller 24 is first started. Since the motor MT1 is operated at a constant frequency, the sound is a simple tone and the sound pressure level is low. Accordingly, the inlet roller 24 is first operated, and next, the drive motor MT4 for the rotation roller 37 is operated, and simultaneously, the drive motor DM1 for the paper storage tray 61 is operated.

By doing so, the device whose sound pressure is relatively low and which is not seen by the user is operated first, so that the start of the operation can be informed to the user. And then, a portion (for example, the paper storage tray 61) which can be seen is operated, so that the user is not very much annoyed at the noise generated by the trial operation.

Figure 16:
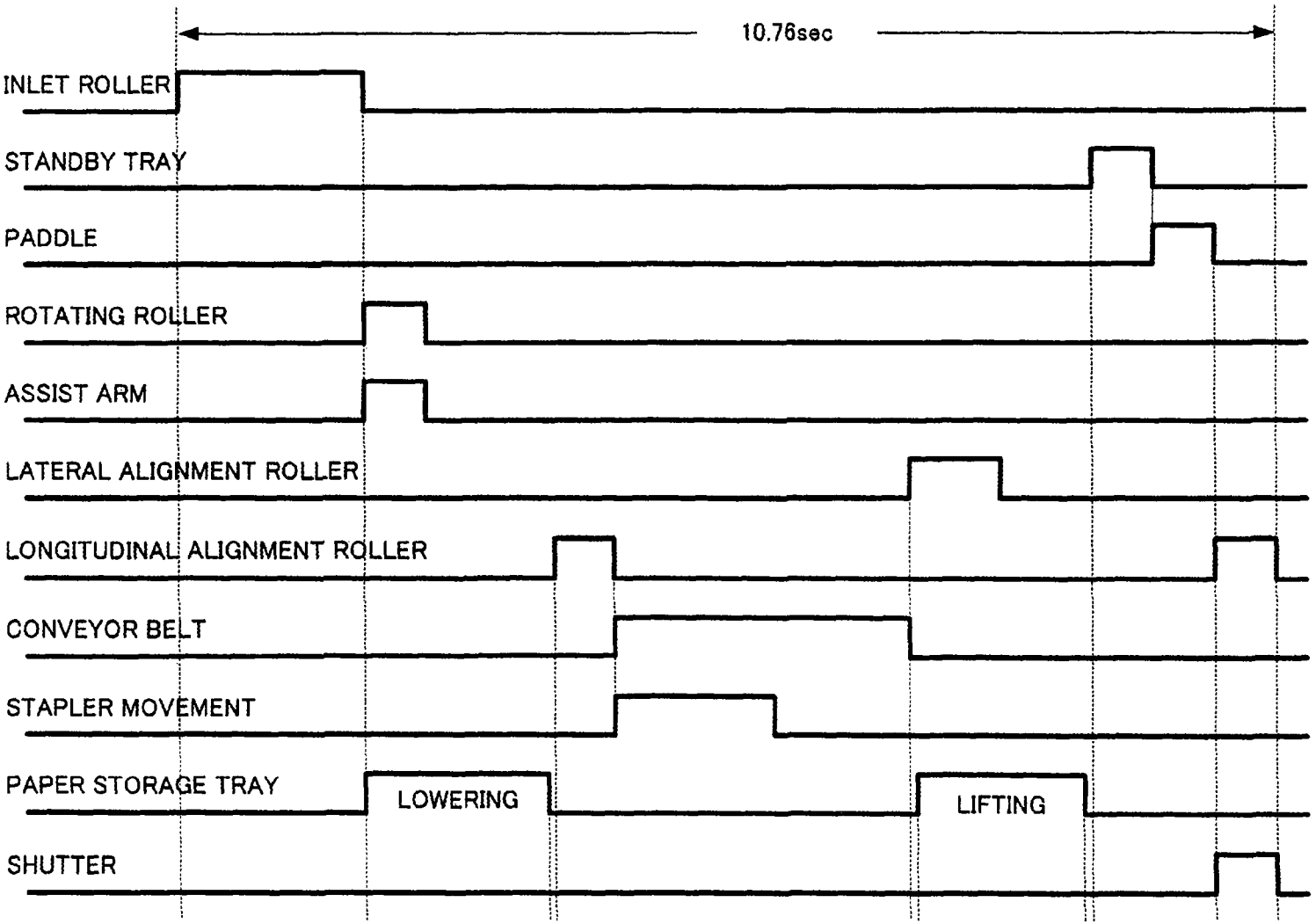
FIG. 16 is a timing chart at the time of trial operation of the sheet finishing apparatus of the embodiment.

FIG. 16 shows an example of the operation timings of the respective devices.

In FIG. 16, when a motor with a high sound pressure level is operating, a motor with a low sound pressure level is operated. For example, during the lowering operation of the paper storage tray 61, the bias arm 39 and the rotation roller 37 are operated, and during the lifting operation of the paper storage tray 61, the lateral alignment plates 41*a* and 41*b* are operated.

Besides, during the operation of the conveyor belt 31, the stapler 23 is moved. Incidentally, with respect to the movement of the stapler 23, the movement may be started before the conveyor belt 31 starts the operation, and the movement may be stopped after the conveyor belt 31 stops the operation.

Besides, in FIG. 16, the inlet roller 24 close to the MFP 10 is first operated. The inlet roller 24 is the device which can not be seen by the user, and the inlet roller 24 is first operated, and next, the rotation roller 37 and the paper storage tray 61 are operated.

Besides, the paper storage tray 61, the conveyor belt 31 and the paddle 28 which are driven by the motors with high sound pressure levels are driven at shifted timings so that they do not operate simultaneously.

Further, the inlet roller 24 is first operated to notify the user of the start of the trial operation, and then, the conveyor belt 31 is driven. Besides, the paper storage tray 61 with the longest operation time is not driven first.

By the contrivances as stated above, the noise at the time of the trial operation can be reduced.

Figure 17:
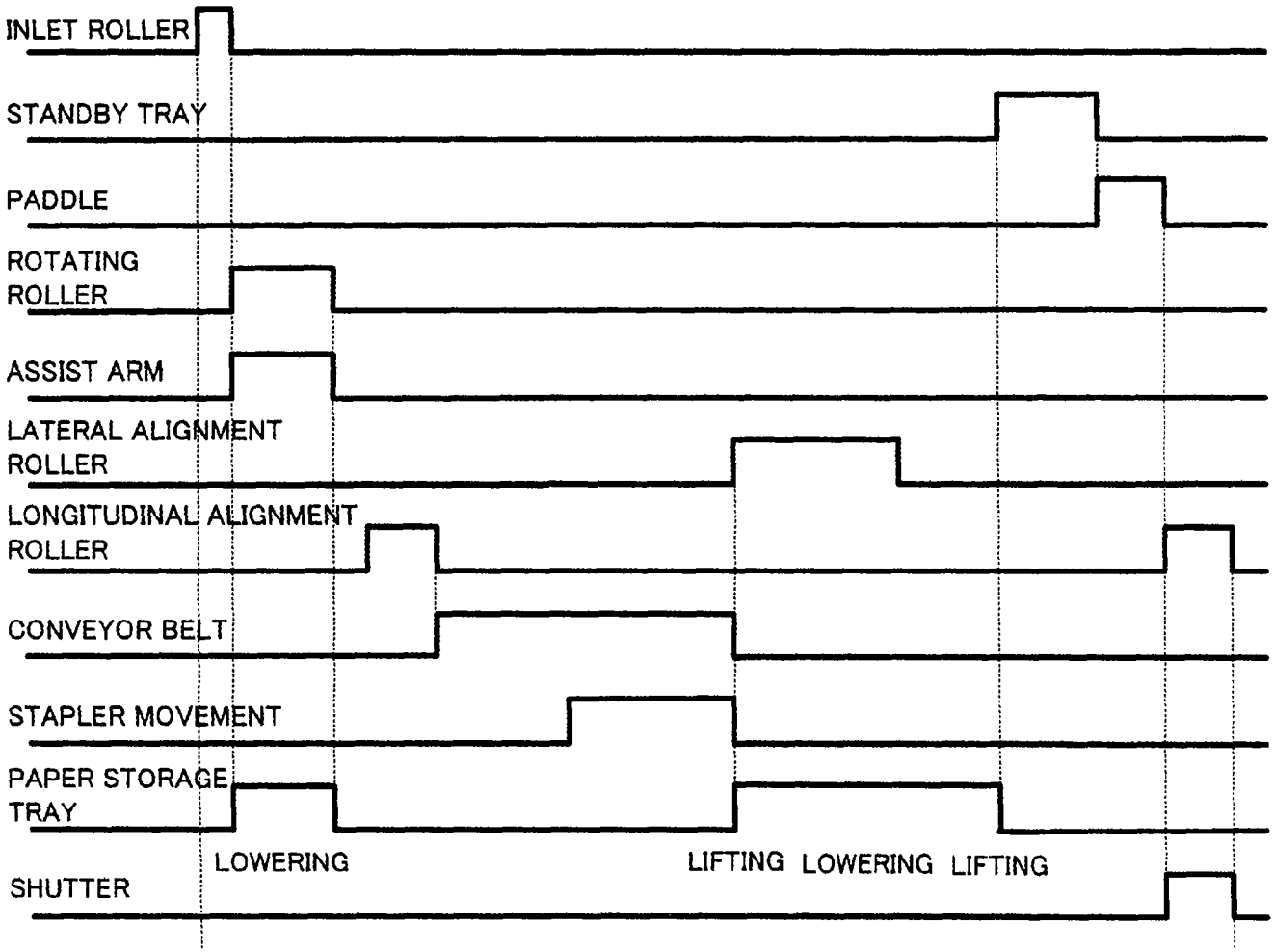
FIG. 17 is another timing chart at the time of trial operation of the sheet finishing apparatus of the embodiment.

Besides, FIG. 17 shows another example of the operation timings of the respective devices. In FIG. 17, the paper storage tray 61, the conveyor belt 31, and the paddle 28, which are driven by the motors with high sound pressure levels, are driven at shifted timings, the rotation roller 37 is operated at the time of the lowering operation of the paper storage tray 61, and the lateral alignment plates 41*a* and 41*b* are driven at the time of the lifting operation of the paper storage tray 61. Besides, the stapler 23 is moved during the operation of the conveyor belt 31.

Figure 18:
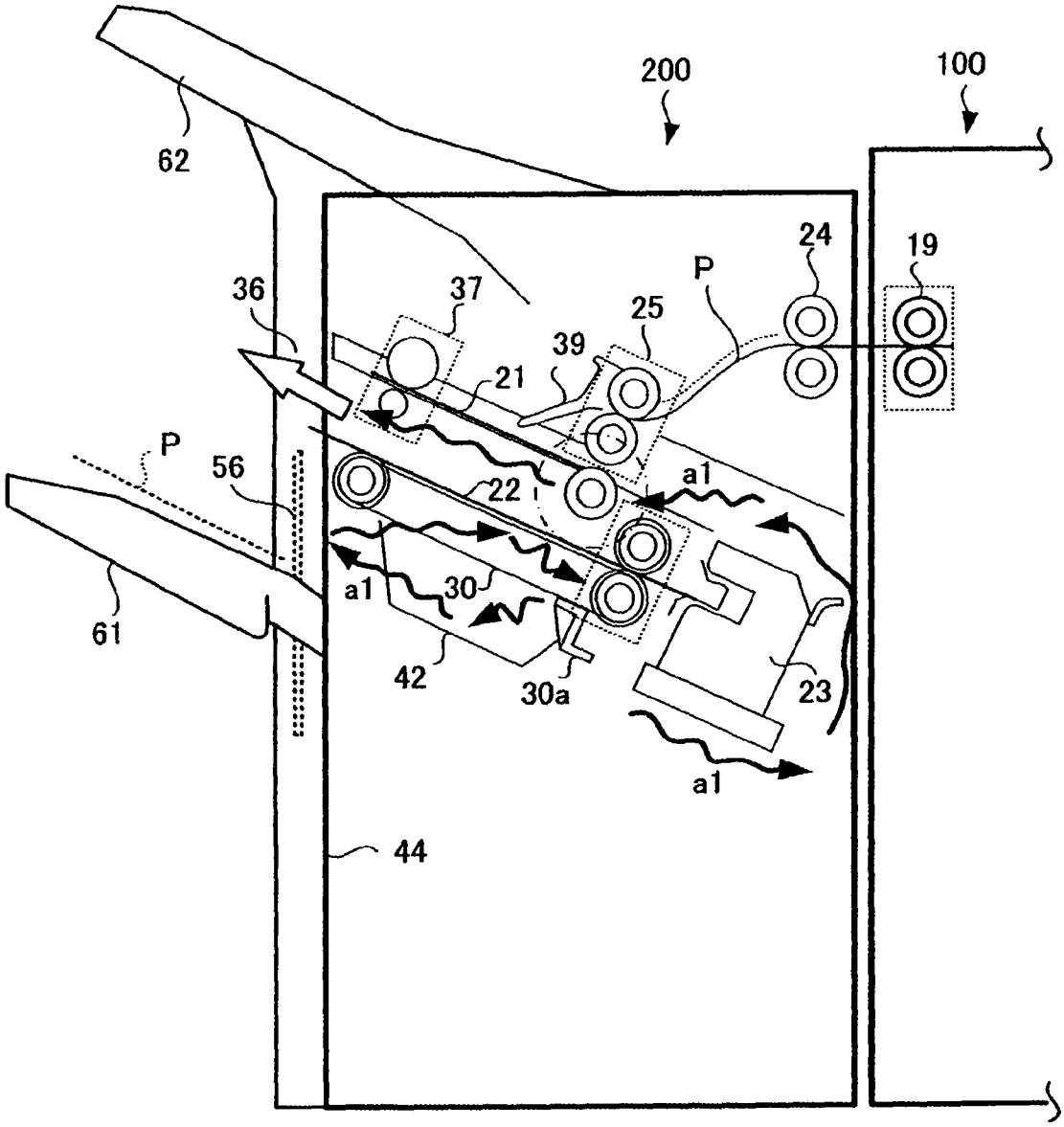
FIG. 18 is an explanatory view showing a noise passage of the sheet finishing apparatus of the embodiment.

On the other hand, as shown in FIG. 18, the finisher 200 has such a structure that a noise is apt to be released from the stapler 23 to the ejection port 36. As a noise source in the finisher 200, for example, there is a sound generated when the conveyor belt 31 (motor MT8) is driven, or a sound generated when the stapler 23 is moved.

These noises are released to the ejection port 36 through a noise passage as indicated by an arrow al in FIG. 18. For example, the noise is reflected in the space between the processing tray 22 and the frame 42, is reflected at the front of the housing 44 and is returned, and resonates in the space and becomes a reverberant sound. The reverberant sound, together with the movement sound of the stapler 23, is transmitted through the peripheral part of the stapler 23, is reflected at the boundary to the MFP 100, is transmitted to between the standby tray 21 and the processing tray 22, and is released from the ejection port 36.

Then, in a second embodiment, in order to further reduce the noise, sound absorbing materials as described below are provided.

Figure 19:
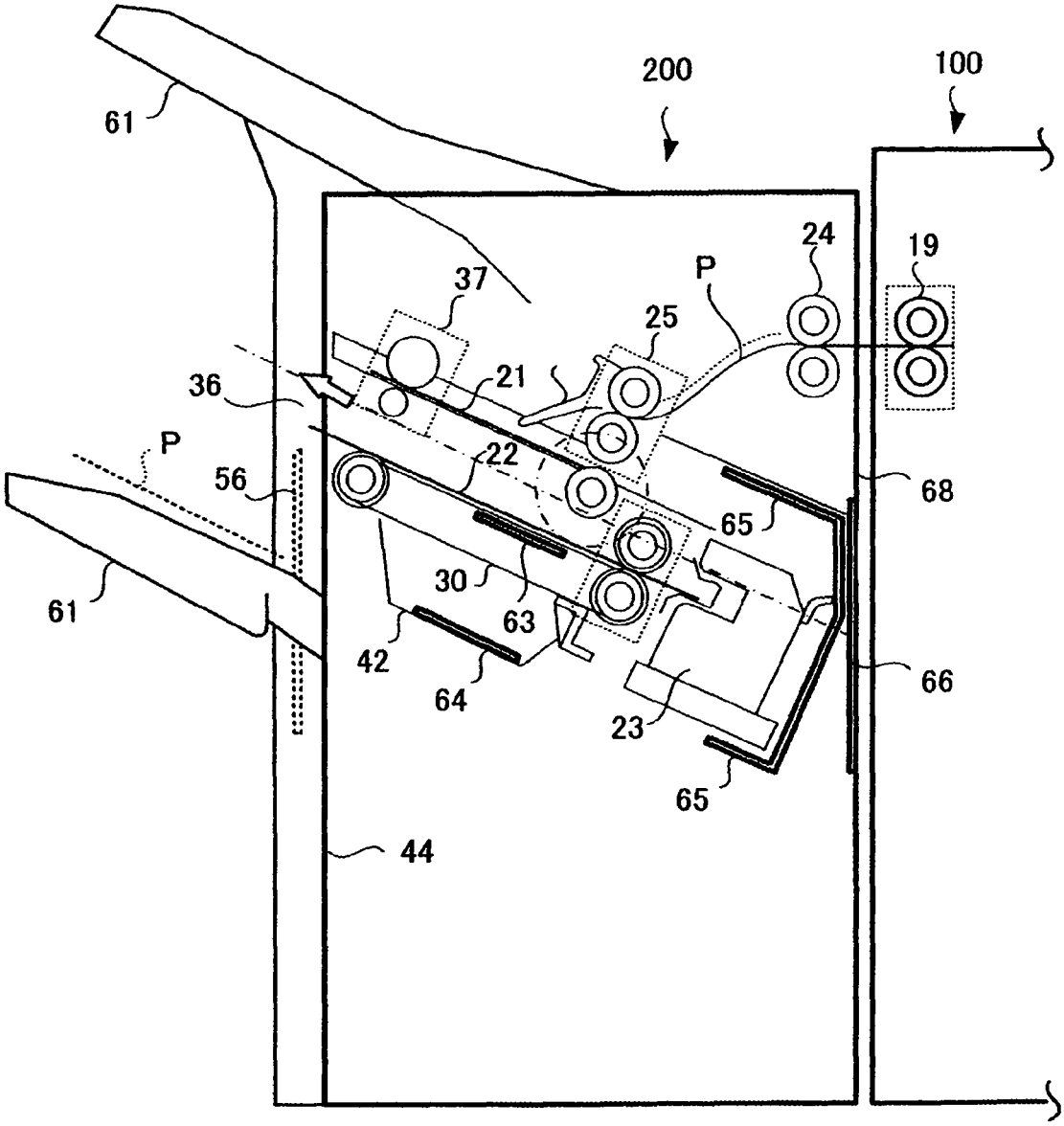
FIG. 19 is a side view showing the arrangement of sound absorbing materials of a sheet finishing apparatus of a second embodiment.

FIG. 19 is an arrangement view of sound absorbing materials 63, 64, 65 and 66. The sound absorbing material 63 is arranged at the lower part of the processing tray 22, and the sound absorbing material 64 is arranged on the upper surface of the frame 42. Besides, the sound absorbing material 65 is arranged so as to surround the movement range of the stapler 23. Further, the sound absorbing material 66 is attached to a cover 68 of the finisher 200, and is provided at a position opposite to the ejection port 36.

Figure 20:
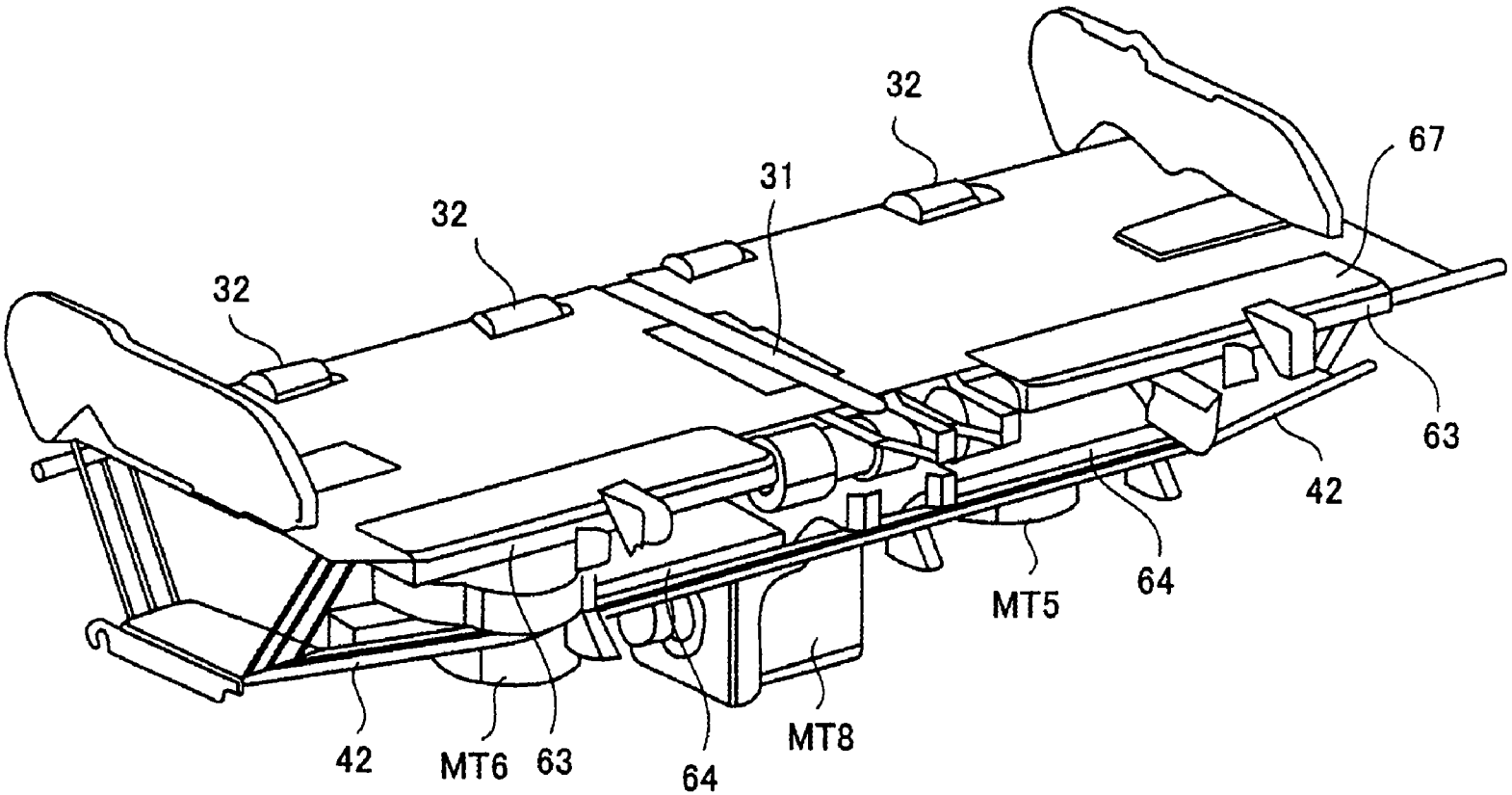
FIG. 20 is a perspective view showing an example of the sound absorbing materials used in the second embodiment.

FIG. 20 is a view in which the device of FIG. 8 is seen from a different angle, and is a perspective view showing the structure of the sound absorbing materials 63 and 64. The sound absorbing material 63 is bonded to the bottom of the frame 67 to which the processing tray 22 is attached, and the sound absorbing material 64 is bonded to the upper surface of the frame 42 to which the motors MT5, MT6 and MT8 are attached.

Accordingly, since the sound generated in the space between the processing tray 22 and the frame 42 is absorbed by the sound absorbing materials 63 and 64, the sound reflected in the space can be reduced, and the resonance and reverberant sound can be reduced. The sound absorbing materials 63 and 64 constitute a first sound absorbing material attached to the processing tray 22 and the frame 42 which are the reflecting surfaces of the noise.

Figure 21:
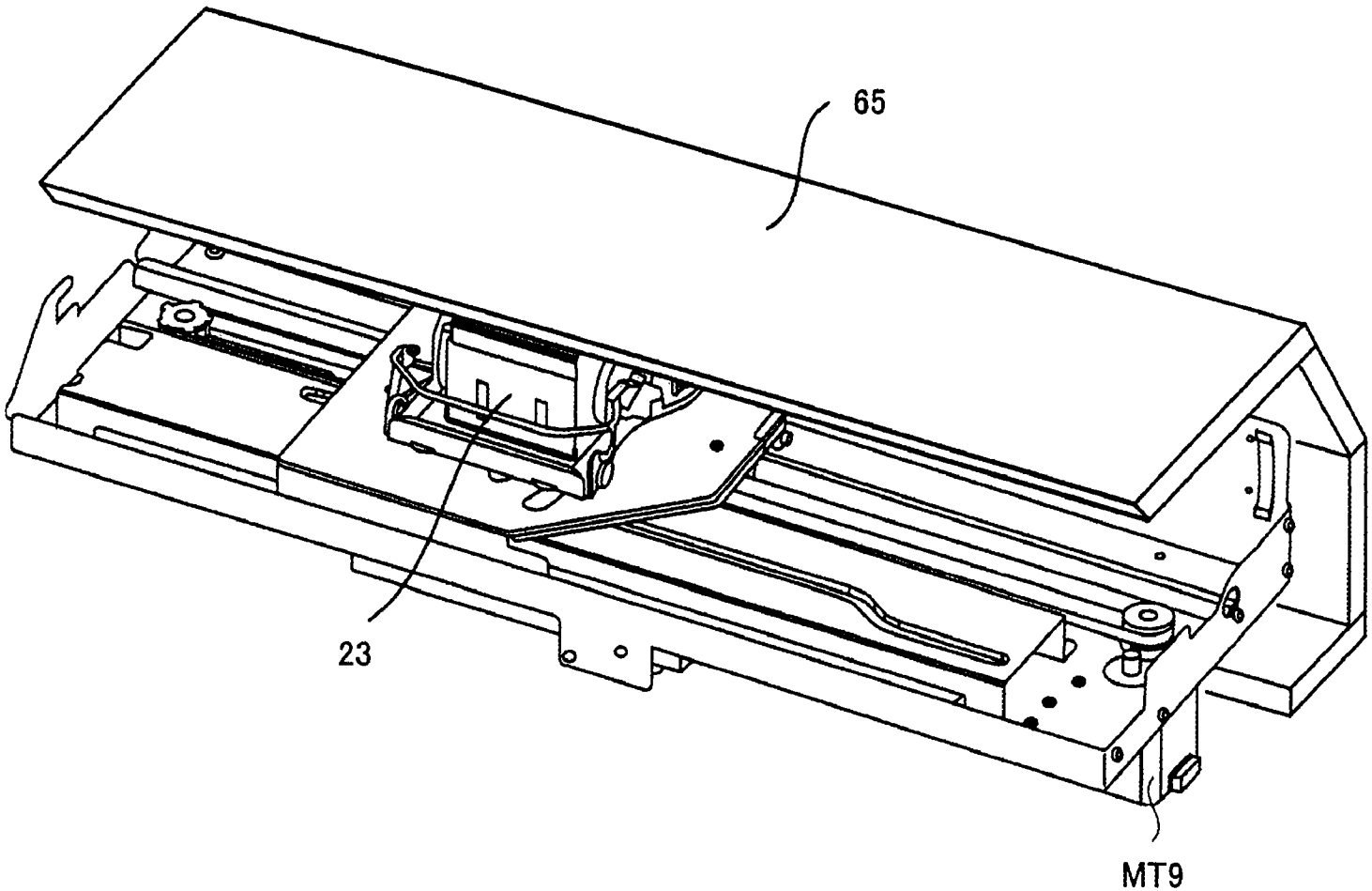
FIG. 21 is a perspective view showing another example of the sound absorbing material used in the second embodiment.

FIG. 21 is a perspective view showing the structure of the sound absorbing material 65. The sound absorbing material 65 is arranged to be long along the movement direction of the stapler 23, and is provided so as to surround the bottom surface, the rear surface and the upper surface (periphery opposite to the ejection port 36) of the stapler 23. The sound absorbing material 65 constitutes a second sound absorbing material.

As stated above, the sound absorbing materials 63, 64 and 65 are attached to the noise passage connected to the ejection port 36, so that the sound generated by the movement of the stapler 23 and the sound transmitted to the ejection port 36 through the peripheral part of the stapler 23 can be reduced.

Figure 22A:
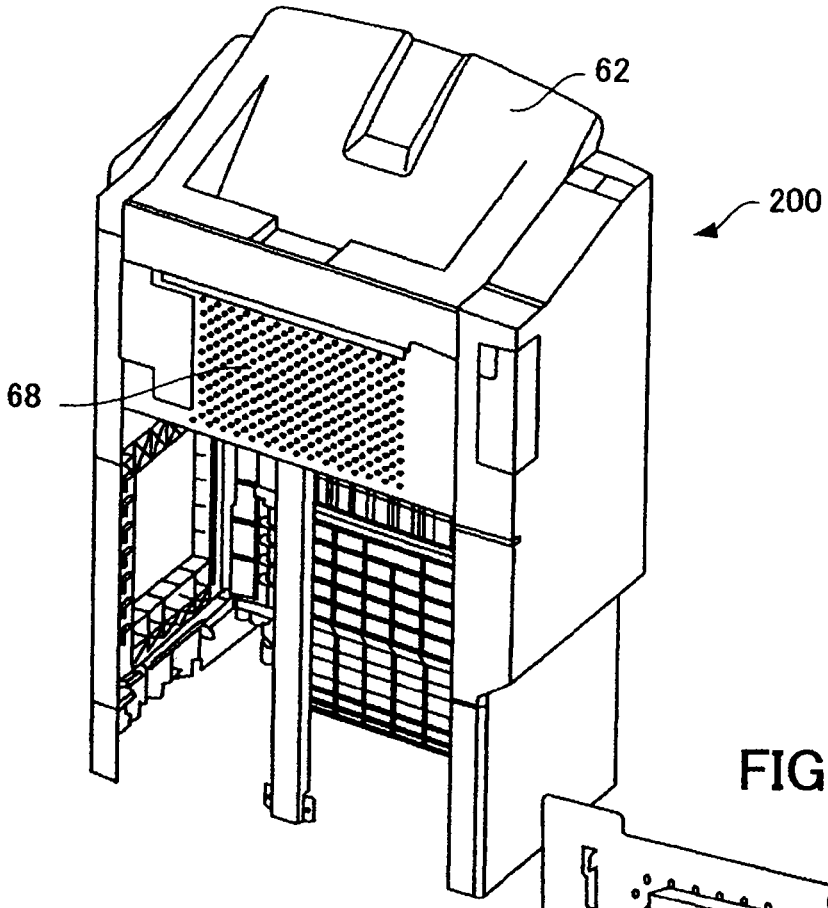
FIG. 22A and FIG. 22B are perspective views showing still another example of the sound absorbing material used in the second embodiment.
Figure 22B:
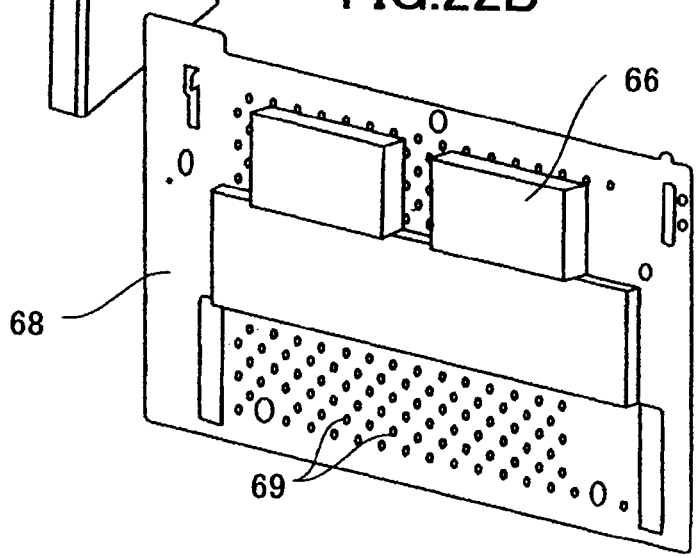

FIGS. 22A and 22B are perspective views showing the structure of the sound absorbing material 66.

FIG. 22A is a perspective view showing the structure of the rear surface part (coupling surface to the MFP 100) of the finisher 200. The cover 68 is attached to the rear surface of the finisher 200 at the side opposite to the MFP, and the sound absorbing material 66 is bonded to the inside of the cover 68. The sound absorbing material 66 constitutes a third sound absorbing material.

FIG. 22B is a view showing the inside of the cover 68. The cover 68 is made of a metal plate in which many lattice-like holes 69 are formed, and the sound absorbing material 66 is bonded to the inside of the metal plate.

Since the rear surface of the finisher 200 is in contact with the MFP 100, the sound generated by the finisher 200 is reflected by the MFP 100, and is directed toward the ejection port 36. Thus, the sound reflected by the MFP 100 is added to the sound generated in the finisher 200, and a large noise occurs. An especially offensive sound in the noise is a sound with a specific frequency.

Then, when the size, the pitch and the number of the lattice-like holes 69 formed in the cover 68 are changed, it is confirmed that sound in an arbitrary frequency band is reduced. Besides, it is confirmed that when the sound absorbing material 66 is bonded to the cover 68, the effect of further reducing the sound with the specific frequency is obtained.

Figure 23A:
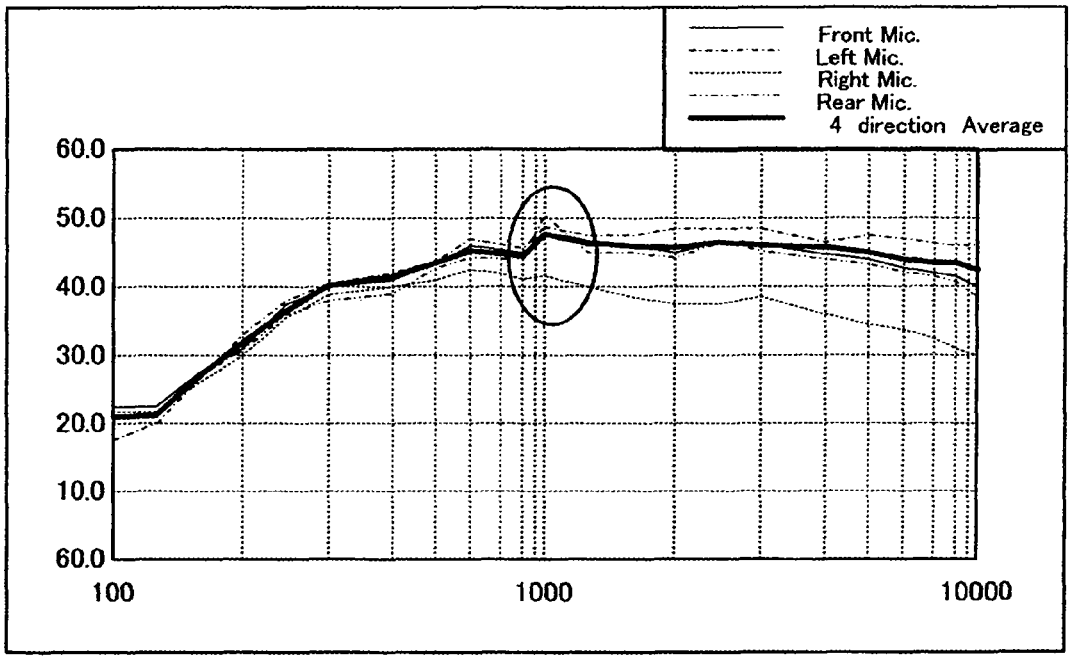
FIGS. 23A and 23B are characteristic views showing a noise reduction effect by a cover of FIG. 22B.
Figure 23B:
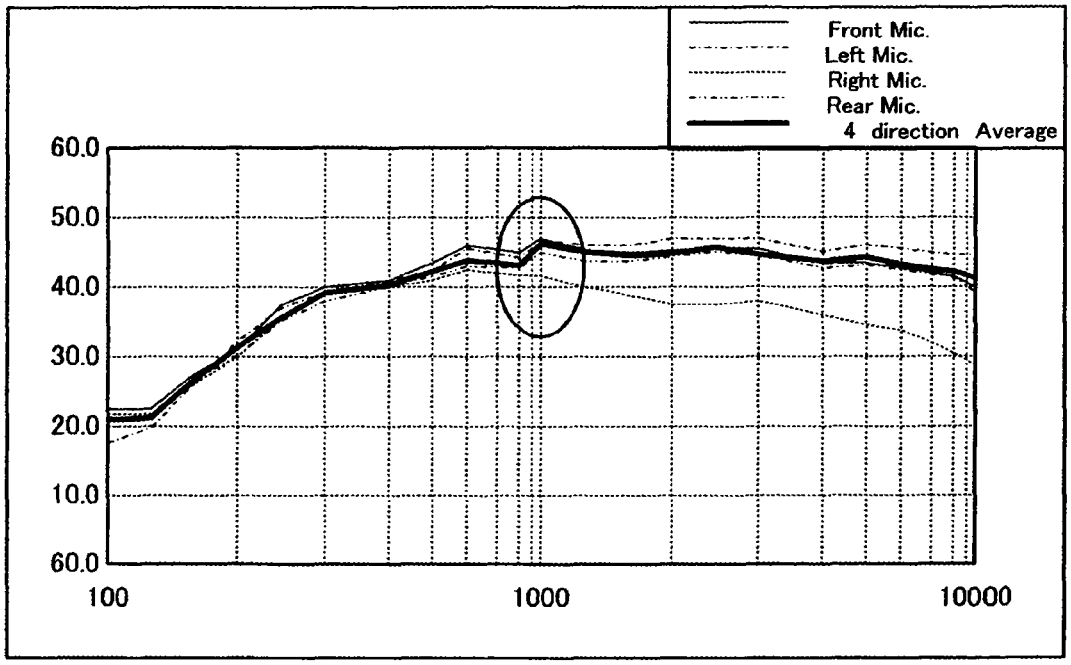

FIG. 23A and FIG. 23B show noise measurement results obtained when the cover 68 having no hole 69 is used and the cover 68 having the holes 69 is used.

FIG. 23A shows the noise characteristic obtained when the cover 68 having no hole 69 is used, and FIG. 23B shows the noise characteristic obtained when the cover 68 having the lattice-like holes 69 is used. The vertical axis indicates the sound pressure level [dBA], and the horizontal axis indicates the frequency.

The measurement is performed such that the sounds of the front surface part (Front mic.), the left side (Left mic.), the right side (Right mic.) and the rear surface part (Rear mic. ) of the finisher 200 are measured by microphones, and an average value (4-direction Average) thereof is obtained. Incidentally, FIGS. 23A and 23B also show the results of measurement made by the noise measurement method and microphone installation method in accordance with the standards of ISO 7779.

As shown in FIG. 23B, it is understood that when the lattice-like holes 69 are provided, the noise in the 1 kHZ frequency band is reduced.

Besides, when the sound absorbing material 66 is bonded to the cover 68 having the lattice-like holes 69, the occurrence of the noise can be further reduced. Besides, when the diameter and the pitch of the holes 69 are changed, the structure can be made such that only the sound in the specific frequency band is hard to be reflected. Besides, since the sound absorbing material 66 is bonded to the position opposite to the ejection port 36, the sound reflected by the cover 68 is reduced and the sound from the ejection port 36 can be reduced. The sound absorbing material 66 constitutes a third sound absorbing material.

Next, a third embodiment will be described with reference to FIG. 24.

Figure 24:
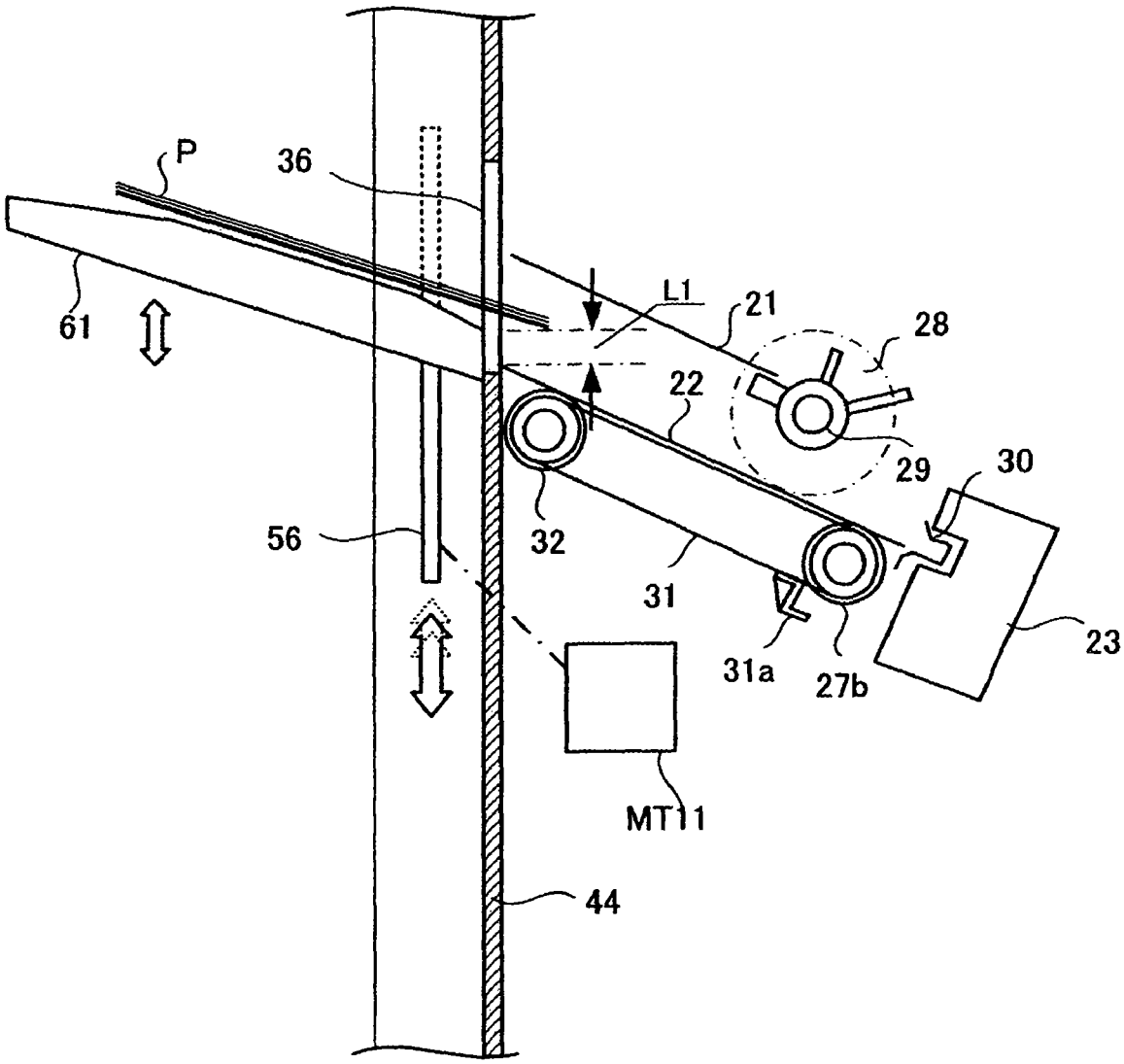
FIG. 24 is a side view for explaining the structure of a sheet finishing apparatus of a third embodiment.

FIG. 24 shows a finisher 200 in which movement control of a shutter 56 and safety measures to the movement of the shutter 56 are provided.

In general, when the finisher 200 is not operating, the shutter 56 is closed. Alternatively, when a sheet is not subjected to a finishing but is ejected to a fixed tray 62, the shutter 56 is closed to reduce the leakage of sound to the outside from the inside of the finisher 200 and to reduce the occurrence of noise.

As described in FIG. 2, in the finisher 200, the user can perform stapling by manual operation. Upon stapling by the manual operation, the user opens (lowers) the shutter 56, and inserts a sheet bundle through the ejection port 36. By this, the stapling can be performed by the stapler 23.

On the other hand, when the finisher 200 is not operating, although the shutter 56 is closed by a lock member such as a spring, when the user applies a comparatively high force, the lock is released and the shutter 56 is opened.

Thus, an automatic returning device is provided which automatically closes the shutter 56 when the shutter 56 is opened and no operation is made even if a certain period is passed. However, since the user can insert the hand before the shutter 56 is closed, this is not desirable in safety.

Then, measures may be taken such that during the period when the finisher 200 stops the operation, the access from the outside by the user is restricted. That is, when the operation of the finisher 200 is stopped, the stop is made at a position where an inside device, for example, the stapler 23 is moved to the center.

As described in FIG. 5, the tray members 21*a* and 21*b* of the standby tray 21 are moved in the directions of arrows m and n, so that the sheet on the standby tray 21 can be made to fall onto the processing tray 22. Besides, when the operation of the finisher 200 is stopped, the tray members 21*a* and 21*b* are moved to the center (direction opposite to the arrows m and n in FIG. 5), and are stopped at the position. In other words, this position is set as the home position of the standby tray 21.

By this, even if the shutter 56 is opened when the operation of the finisher 200 is stopped, by the standby tray 21, it is possible to prevent the hand or the like from entering the inside of the finisher 200.

Besides, when the shutter 56 is automatically returned, the motor MT11 is used to perform control so that the shutter 56 is gradually stepwise closed. By this, it is notified to the user that the shutter 56 is closed, and it is possible to prevent the hand from being nipped by the shutter 56.

On the other hand, when the shutter 56 is opened and the user presses the operation button of the manual stapling, the tray members 21*a* and 21*b* of the standby tray 21 open in the direction of the arrows m and n (see FIG. 5), and the user can insert a sheet bundle through the opening 35. At this time, the stapler 23 becomes operable, and the stapling can be performed. The operation button of the manual stapling may be provided on, for example, the control panel 13.

Incidentally, at the time of the operation of the manual stapling, the height of the paper storage tray 61 is made higher than the height of the processing tray 22 by L1. L1 is preferably 30 mm to 50 mm. The height position of the paper storage tray 61 is controlled by controlling the driving of the motor DM1. By this, the insertion of the sheet is facilitated.

Next, a fourth embodiment will be described this embodiment relates to a finisher 200 in which power consumption is reduced.

Figure 25:
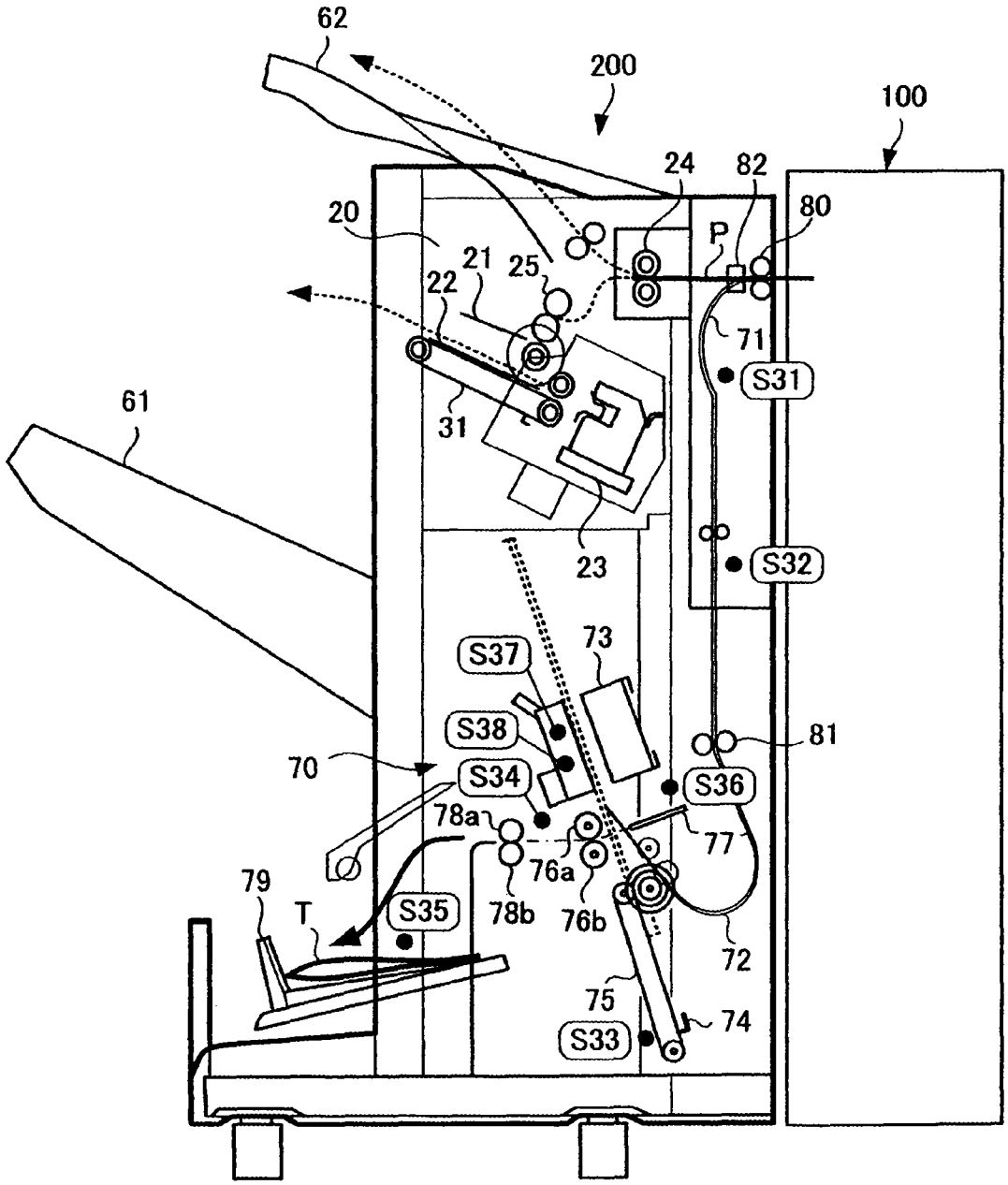
FIG. 25 is a side view showing the structure of a saddle unit used in a sheet finishing apparatus of a fourth embodiment.

The finisher 200 may include, in addition to a first finishing unit to perform a stapling or sorting (first finishing process), a saddle unit (second finishing unit) to saddle-stitch sheets and to fold them in half. FIG. 25 is a structural view of the finisher 200 including a saddle unit 70 in addition to a staple mechanism 20.

The saddle unit 70 is a device to bundle sheets (plural sheets) supplied from an MFP 100, saddle-stitches them, and folds them in half.

The sheet P conveyed from the MFP 100 is conveyed through a paper path 71, and is further conveyed through a paper path 72 in the direction of a stapler 73, and is once received on a stack tray 74. The conveyed sheet P is sequentially stacked on the stack tray 74 and a sheet bundle is formed.

The sheet bundle T on the stack tray 74 is conveyed in the direction of the stapler 73 by a guide belt 75, and when the center of the sheet bundle T reaches the stapler 73, the guide belt 75 is once stopped, and stapling is performed to the center of the sheet bundle T by the stapler 73.

The sheet bundle T subjected to the stapling by the stapler 73 is lowered by the guide belt 75, and is stopped at a position where the center of the sheet bundle T reaches a nip point of a pair of folding rollers 76*a* and 76*b*. A blade 77 is disposed at a position opposite to the pair of folding rollers 76*a* and 76*b*.

The blade 77 presses the center of the sheet bundle T to the nip point of the pair of folding rollers 76*a* and 76*b*, and pushes the sheet bundle T into between the pair of folding rollers 76*a* and 76*b*. Thereafter, the pair of folding rollers 76*a* and 76*b* rotates while folding and nipping the sheet bundle T, and folds the sheet bundle T in half. The sheet bundle T folded in half is reinforced by a pair of ejecting rollers 78*a* and 78*b*, and is ejected to a paper storage tray 79.

Incidentally, in order to guide the sheet P supplied from the MFP 100 along the paper paths 71 and 72, guide rollers 80 and 81 are provided. Besides, a gate 82 is provided at the outlet of the guide roller 80 in order to change the convey of the sheet P supplied from the MFP 100 to the stapler 23 side or the saddle unit 70 side.

If the folding of the sheet is not performed, the gate 82 conveys the sheet P ejected from the MFP 100 to an inlet roller 24. If the fold process of the sheet is performed, the sheet P is conveyed to the saddle unit 70.

Incidentally, although the pair of ejecting rollers 78*a* and 78*b* performs the reinforcing process, the reinforcing mechanism is not limited to the illustrated example, and another reinforcing mechanism can also be used.

In the finisher 200 as stated above, while the staple mechanism 20 is operating, the saddle unit 70 is stopped.

Besides, a control system to control the staple mechanism 20 and a control system to control the saddle unit 70 are operated by electric power supplied from the MFP 100. Accordingly, when the power consumption of the power source is not considered, the respective control systems may be continuously energized by the power from the MFP 100. However, consumption current supplied from the MFP 100 is limited, and when the power is applied in a state close to the limited consumption current, it is necessary to suppress the power consumption.

Figure 26:
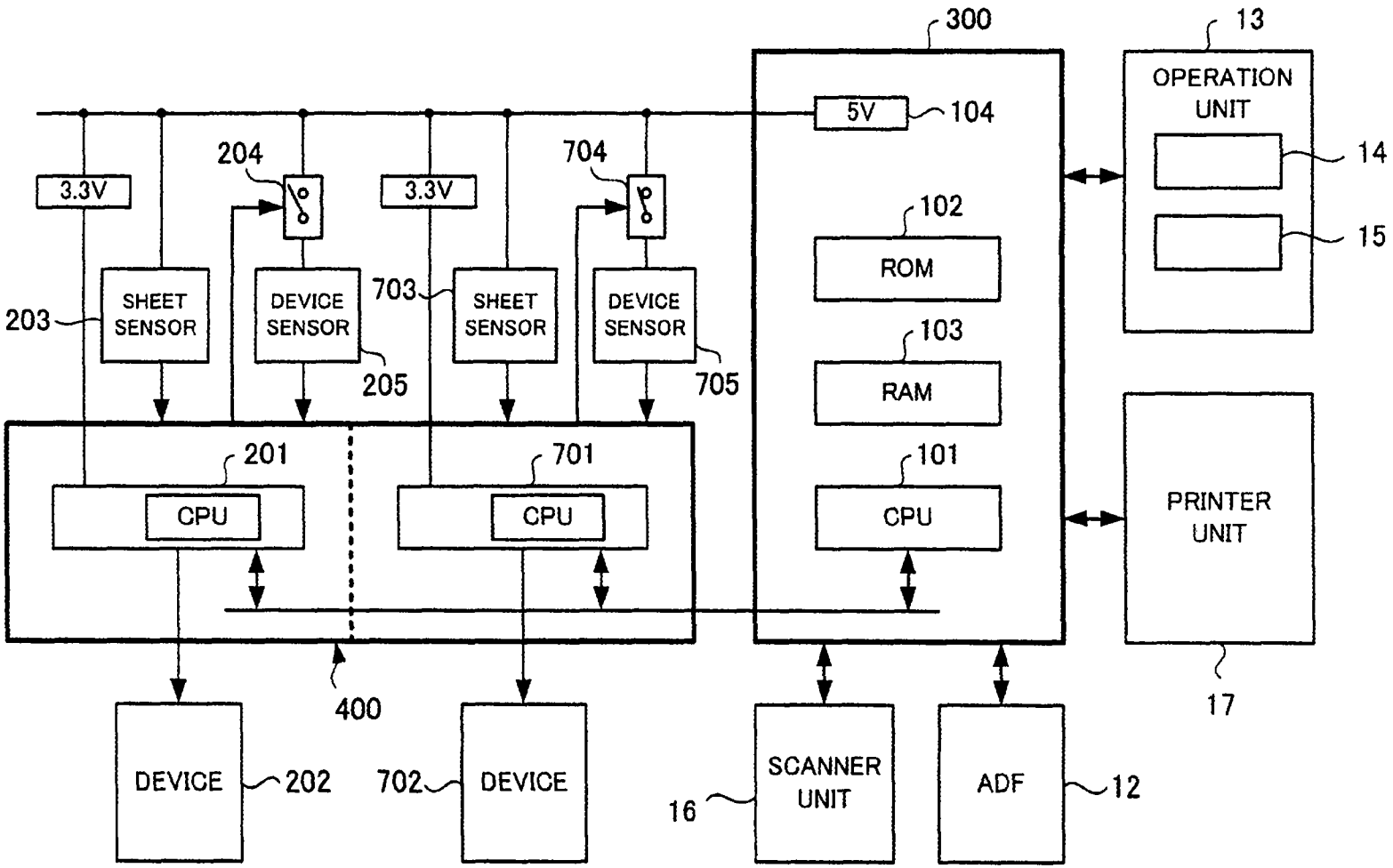
FIG. 26 is a block diagram showing a control system of the sheet finishing apparatus of the embodiment.

Then, in this embodiment, a control system as shown in FIG. 26 is provided. FIG. 26 is a block diagram showing the control system of the MFP 100 and the finisher 200.

In FIG. 26, a main control unit 300 includes a CPU 101, a ROM 102 and a RAM 103, and controls the MFP 100 in accordance with a control program stored in the ROM 102. The main control unit 300 controls the operation of an ADF 12, a scanner unit 16, and a printer unit 17 in response to the operation from an operation panel 13. The RAM 103 temporarily stores control data, and is used for arithmetic operation at the time of control.

The operation panel 13 includes an operation unit 14 including plural keys, and a display unit 15 which is used also as a touch panel, and can give various instructions for image formation. For example, the instruction of the number of copy sheets and the operation of manual stapling are performed using the operation unit 14, and the instructions of a sheet size, a sheet kind, stapling, sheet folding and the like are performed by operating the touch panel of the display unit 15.

Besides, a control unit 400 to the control finisher 200 is included. The control unit 400 controls the operation of the staple mechanism 20 and the saddle unit 70 of the finisher 200. Besides, at the time of trial operation, respective devices in the finisher 200 are controlled.

The control unit 400 includes a first control unit 201 including a CPU and a second control unit 701 including a CPU, the CPUs of the first and the second control units 201 and 701 are connected to the CPU 101 of the main control unit 300 through a bus line, information is transmitted between the main control unit 300 and the control unit 400, and the MFP 100 and the finisher 200 operate in cooperation with each other.

The first control unit 201 controls respective devices 202 of the staple mechanism 20, and the second control unit 701 controls respective devices 702 of the saddle unit 70. The control of the staple mechanism 20 includes execution of stapling by the stapler 23, convey of the sheet P to the stapler 23, and ejection of the sheet after stapling.

The control of the saddle unit 70 includes convey of the sheet P through the paper path 71, movement and positioning of the sheet bundle T by the guide belt 75, execution of stapling by the stapler 73, and protrusion of the folding blade 77. Further, the control includes rotation control of the folding rollers 76*a* and 76*b* and the ejecting rollers 78*a* and 78*b*.

Incidentally, the devices 202 include the standby tray 21, the processing tray 22, the stapler 23, the conveyor belt 31 and the like. Besides, the devices 702 include the stapler 73, the stack tray 74, the guide belt 75, the pair of folding rollers 76*a* and 76*b*, the blade 77 and the like.

The control unit 400 is connected with a sheet sensor 203 of the staple mechanism 20 and a device sensor 204, and is further connected with a sheet sensor 703 of the saddle unit 70 and a device sensor 705.

The control unit 400 uses detection results of the sensors 203 and 205 and controls the respective devices of the staple mechanism 20. Besides, the control unit uses detection results of the sensors 703 and 705, and controls the respective devices of the saddle unit 70.

For example, a power voltage of 5 V is obtained from a voltage source 104 of the MFP 100, and is supplied to the sheet sensor 203 and the sheet sensor 703. Besides, the power voltage of 5V is supplied to the device sensor 205 of the staple mechanism 20 and the device sensor 705 of the saddle unit 70 through switch circuits 204 and 704. Further, the power voltage of 5V is converted into 3.3 V, and is supplied to the first and the second control units 201 and 701.

The sheet sensor 203 detects the presence or absence of a sheet in the staple mechanism 20, and the sheet sensor 703 detects the presence or absence of a sheet in the saddle unit 70. Besides, the device sensor 205 is for detecting the states of the respective devices of the staple mechanism 20, and the device sensor 705 is for detecting the states of the respective devices of the saddle unit 70.

The detection results of the sheet sensor 203 and the device sensor 205 are supplied to the first control unit 201. The detection results of the sheet sensor 703 and the device sensor 705 are supplied to the second control unit 701. By this, the first and the second control units 201 and 701 control the devices 202 and 702 in response to the detection results.

The first control unit 201 controls the switch circuit 204, the second control unit 701 controls the switch circuit 704, and while the staple mechanism 20 is operating, the switch circuit 204 is put in an on state, and the switch circuit 704 is put in an off state. On the other hand, while the saddle unit 70 is operating, the switch circuit 204 is put in an off state, and the switch circuit 704 is put in an on state. Besides, the first and the second control units 201 and 701 perform control so that while one of the device 202 and the device 702 is operating, the other is not operated.

That is, in the control system of FIG. 26, while the staple mechanism 20 is operating, the operation of the saddle unit 70 is stopped and power consumption is suppressed, and similarly, while the saddle unit 70 is operating, the operation of the staple mechanism 20 is stopped and power consumption is suppressed.

However, when the operation of the saddle unit 70 is completely stopped while the staple mechanism 20 is operating, when a sheet stays in the saddle unit 70, or when a sheet is conveyed in the saddle unit 70, that can not be detected. Accordingly, only the second control unit 701 and the sheet sensor 703 are kept in an operational state.

Besides, when the operation of the staple mechanism 20 is completely stopped while the saddle unit 70 is operating, when a sheet stays in the staple mechanism 20, or when a sheet is conveyed in the staple mechanism 20, that can not be detected. Accordingly, only the first control unit 201 and the sheet sensor 203 are kept in an operational state.

In this way, since the information of staying of a sheet can be accurately acquired, it is possible to confirm where the sheet is stayed or whether the sheet is conveyed.

Incidentally, although the power voltage to the sheet sensors 203 and 703 is always supplied from the power line of 5V, as the need arises, only when, for example, the MFP 100 requests detection of the presence or absence of staying of a sheet or the presence or absence of a sheet being conveyed, the power voltage may be supplied.

For example, while the staple mechanism 20 is operating, the supply of the power voltage to the sheet sensor 703 of the saddle unit 70 is stopped, however, only when it is desired to detect the presence or absence of staying of a sheet or the presence or absence of a sheet being conveyed, the power voltage may be supplied to the-sheet sensor 703. Similarly, while the saddle unit 70 is operating, the supply of the power voltage to the sheet sensor 203 of the staple mechanism 20 is stopped, however, only when it is desired to detect the presence or absence of staying of a sheet or the presence or absence of a sheet being conveyed, the power voltage may be supplied to the sheet sensor 203.

In this way, the power consumption is reduced as much as possible.

Incidentally, the sheet sensor 203 of the staple mechanism 20 includes a sensor group including sensors S1, S2, S12, S16, S17 and S18 shown in FIGS. 12A and 12B.

The sensors S1 and S2 detect the presence or absence of a sheet at the inlet roller 24 and the paper feed roller 25, respectively. The sensor S12 detects ejection of a sheet, and the sensors S16 and S17 detect the presence or absence of a sheet on the upper surface of the paper storage tray 61 and overloading. Besides, the sensor S18 detects the presence or absence of a sheet on the upper surface of the fixed tray 62.

Besides, the device sensor 205 of the staple mechanism 20 includes a sensor group including sensors S3 to S5, S9, S10, S13 to S15 shown in FIGS. 12A and 12B.

The sensors S3, S4 and S5 detect the home positions of the paddle 28, the shutter 56 and the bias arm 39, respectively. The sensor S9 detects the home position of the conveyor belt 31, and the sensor S10 detects the movement of the stapler 23. The sensors S13, S14 and S15 detect the height position of the paper storage tray 61.

Besides, the sheet sensor 703 of the saddle unit 70 includes a sensor group including sensors S31 to S35 indicated by black dots of FIG. 25.

The sensor S31 detects the presence or absence of a sheet at the inlet, the sensor S32 detects the presence or absence of a sheet at the paper path 71, and the sensor S33 detects the presence or absence of a sheet at the stack tray 74. The sensor S34 detects the eject of a sheet, and the sensor S35 detects the presence or absence of a sheet on the upper surface of the paper storage tray 79.

Besides, the device sensor 705 of the saddle unit 70 includes a sensor group including sensors S36 to S38 indicated by black dots of FIG. 25. The sensor S36 detects the home position of the blade 77, the sensor S37 detects the home position of the stapler 73, and the sensor S38 detects the absence of a needle of the stapler 73.

Incidentally, as shown in FIG. 2, when the punch mechanism 90 is provided, the punch mechanism 90 and the staple mechanism 20 are simultaneously operated, and while the punch mechanism 90 and the staple mechanism 20 are operating, the operation of the saddle unit 70 is stopped.

Also in the punch mechanism 90, since there are a sheet sensor and a device sensor, the sheet sensor of the punch mechanism 90 may be assembled in the sheet sensor 203 of FIG. 26, and the device sensor of the punch mechanism 90 may be assembled in the device sensor 205 of FIG. 26.

Figure 27:
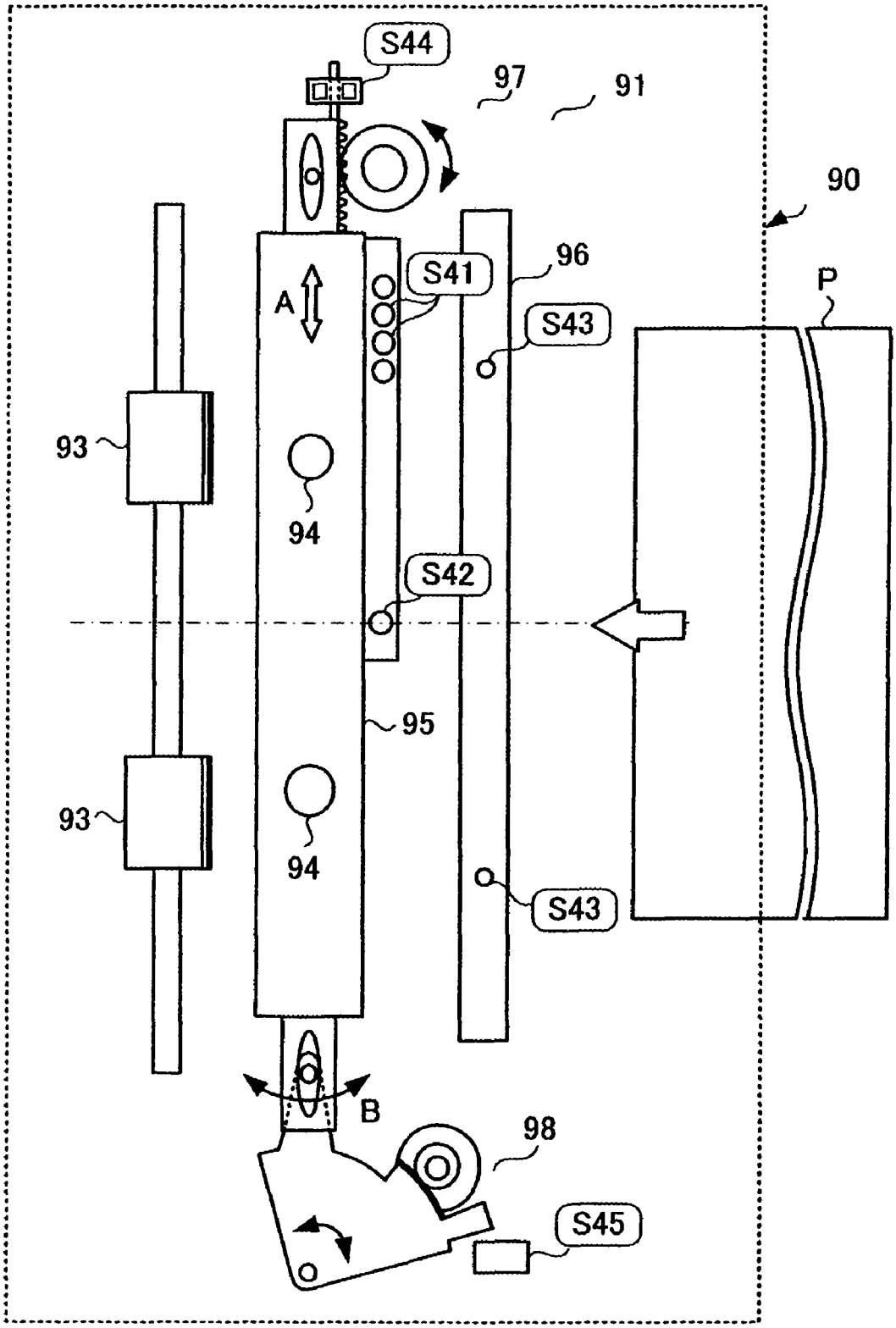
FIG. 27 is a plan view showing the structure of a punch mechanism used in the sheet finishing apparatus of the fourth embodiment.

FIG. 27 is a plan view schematically showing the structure of the punch mechanism 90.

The punch mechanism 90 is disposed between the MFP 100 and the staple mechanism 20, and includes a punch unit 91 and a dust box 92 (see FIG. 2) Besides, a roller 93 for conveying a sheet is provided.

The punch unit 91 is provided with a punch boring unit 95 having a boring blade 94 to perform a punch process to a sheet. When the boring blade 94 is lowered, a punch hole is bored in the sheet P. Punch dust produced by the punch process falls into a dust box 92. The boring blade 94 is driven in the direction of the sheet P by the rotation of a punch motor (not shown).

The punch process performed by the punch unit 91 is executed when the user operates the operation panel 13 and a punch mode is set.

The punch unit 91 performs the punch process on the sheet P, and has a function to correct the skew of the sheet P. Thus, a skew detection unit 96 to detect the skew (inclination) of the sheet P is included.

The punch boring unit 95 can move in the direction of an arrow A (lateral direction) perpendicular to the conveying direction of the sheet P, and one end (lower end in the drawing) of the punch boring unit 95 can be rotated by a specified angle in the direction of an arrow B (longitudinal direction) along the conveying direction of the sheet P.

Besides, there are provided a movement mechanism 97 to move the punch boring unit 95 in the lateral direction (direction of the arrow A) and a posture control unit 98 to control the posture by rotating the punch boring unit 95 in the longitudinal direction (direction of the arrow B).

The punch boring unit 95 moves in the direction of the arrow A in accordance with the position of the carried-in sheet P. Besides, in accordance with the inclination of the carried-in sheet P, the punch boring unit is rotated in the direction of the arrow B, is inclined and corrects the skew.

Besides, the punch boring unit 95 is provided with a sensor S41 for detecting the end (lateral end) of the sheet P in the lateral direction, and is further provided with a sensor S42 for detecting the leading edge and the trailing edge of the sheet P when the sheet P is conveyed. Besides, the skew detection unit 96 is provided with a sensor S43 for skew detection.

Further, there are provided a sensor S44 for detecting the home position of the punch boring unit 95 in the lateral direction (A direction) and a sensor S45 for detecting the home position in the longitudinal direction (B direction).

The sensors S41, S42 and S43 correspond to the sheet sensors of the punch mechanism 90, and the sensors S44 and S45 correspond to the device sensors of the punch mechanism 90. If the punch mechanism 90 has a sensor for detecting that the dust box 92 becomes full of dust, the full sensor corresponds to the device sensor.

In this way, in the finisher 200, while one of the staple mechanism 20 (and the punch mechanism 90) and the saddle unit 70 is operating, only a minimum necessary portion (sheet sensor) of the other is operated, so that the power consumption can be reduced.

As described above, the sheet finishing apparatus can be provided in which the noise at the time of trial operation is reduced, and the power consumption is reduced.

Incidentally, no limitation is made to the above description, and various modifications can be made within the scope not departing from the claims.

Although exemplary embodiments are shown and described, it will be apparent to those having ordinary skill in the art that a number of changes, modifications, or alterations as described herein may be made, none of which depart from the spirit. All such changes, modifications, and alterations should therefore be seen as within the scope.

What is claimed is:

1. A sheet finishing apparatus, comprising:

an inlet roller to receive a sheet;

a sheet introduction unit configured to align the sheet received by the inlet roller;

a finishing unit configured to perform finishing on the sheet conveyed by the sheet introduction unit;

a sheet ejection unit configured to guide the sheet performed to the finishing by the finishing unit to an ejection port and to eject the sheet from the ejection port;

a storage tray that moves up and down and receives the sheet ejected from the ejection port;

a drive unit configured to drive respective devices existing between the inlet roller and the storage tray and including a plurality of motors having sound pressure levels less than a previously set reference level and a plurality of motors having sound pressure levels higher than the previously set reference level; and a control unit configured to control the drive unit in a trial operation of the sheet finishing apparatus, to first drive any one of the motors having the sound pressure levels less than the previously set reference level, and then to drive other motors including the plurality of motors having the sound pressure levels higher than the previously set reference level.

2. The apparatus of claim 1, wherein the motor first driven is the motor to drive the inlet roller.

3. The apparatus of claim 1, wherein the sheet introduction unit includes a processing tray to guide the aligned sheet to the finishing unit, and a paddle to guide the sheet supplied via the inlet roller onto the processing tray, the sheet ejection unit includes a conveyor belt to guide the sheet from the processing tray to the ejection port, and the control unit first drives a motor to drive the inlet roller, and then drives a motor to drive the storage tray, a motor to drive the conveyor belt, and a motor to drive the paddle alternatively, during the trail operation.

4. The apparatus of claim 3, wherein the finishing unit is a stapler to staple the sheet, the sheet introduction unit further includes a lateral alignment plate to laterally align the sheet in a direction perpendicular to a conveying direction, and the control unit drives a motor to move the stapler when the conveyor belt is driven, and drives a motor to drive the lateral alignment plate when the storage tray is driven.

5. The apparatus of claim 1, wherein the control unit first drives a motor having a shortest operation time among the plurality of motors having the sound pressure levels less than the previously set reference level, during the trail operation.

6. The apparatus of claim 5, wherein the motor having the shortest operation time among the plurality of motors having the sound pressure levels less than the previously set reference level is the motor to drive the inlet roller.

7. The apparatus of claim 1, wherein the control unit first drives a motor, among the plurality of motors having the sound pressure levels less than the previously set reference level, to drive a device which is not seen from outside of the sheet finishing apparatus, during the trail operation.

8. The apparatus of claim 7, wherein the control unit first drives a motor to drive the inlet roller, and then drives a motor to drive another device, during the trail operation.

9. The apparatus of claim 7, wherein the control unit drives any one of the plurality of motors having the sound pressure levels less than the previously set reference level before the storage tray is driven, during the trail operation.

10. The apparatus of claim 9, wherein the motor first driven is the motor to drive the inlet roller.

11. The apparatus of claim 7, wherein the sheet introduction unit includes a standby tray to receive the sheet conveyed from the inlet roller before the sheet is laterally aligned, and a pusher to hold the sheet on the standby tray, and the control unit simultaneously drives a motor to drive the storage tray and a motor to drive the pusher, during the trail operation.

12. A control method of a sheet finishing apparatus, comprising:

in a normal mode in which a sheet is conveyed and is performed to finishing, receiving the sheet by an inlet roller;

aligning the sheet, which is received by the inlet roller, by a sheet introduction unit and guiding to a finishing unit;

guiding the sheet performed to the finishing to an ejection port by a sheet ejection unit; and receiving the sheet ejected from the ejection port by a storage tray that moves up and down, and in a trial operation of the sheet finishing apparatus, driving respective devices existing between the inlet roller and the storage tray by a drive unit; and first driving any one of a plurality of motors having sound pressure levels less than a previously set reference level, which are included in the drive unit, and then driving another motor.

13. The control method of claim 12, wherein the inlet roller is first driven during the trail operation.

14. The control method of claim 12, wherein the finishing unit is a stapler, the sheet introduction unit includes a processing tray to guide the aligned sheet to the stapler, and a paddle to guide the sheet supplied via the inlet roller onto the processing tray, the sheet ejection unit includes a conveyor belt to guide the sheet from the processing tray to the ejection port, and the inlet roller is first driven, and then, the storage tray, the conveyor belt and the paddle are alternatively driven, during the trail operation.

15. The control method of claim 14, wherein the sheet introduction unit further includes a lateral alignment plate to laterally align the sheet in a direction perpendicular to a transport direction, and the stapler is moved at a time of driving of the conveyor belt, and the lateral alignment plate is driven at a time of driving of the storage tray.

16. The control method of claim 12, wherein among the plurality of motors, a motor to drive an inside device whose movement is not seen from outside is first driven, during the trail operation.

17. The control method of claim 16, wherein the inlet roller is first driven, and then, another device is driven during the trail operation.

18. The control method of claim 16, wherein before the storage tray is driven, another device is driven during the trail operation.

* * * * *